US008353510B2

(12) United States Patent
Lindsay et al.

(10) Patent No.: US 8,353,510 B2
(45) Date of Patent: Jan. 15, 2013

(54) VARIABLE MEDIA FEED SYSTEM AND PRINTHEAD APPARATUS

(76) Inventors: Brett A. Lindsay, Rochester, NH (US); Jerry A. Carper, Rochester, NH (US)

( * ) Notice: Subject to any disclaimer, the term of this patent is extended or adjusted under 35 U.S.C. 154(b) by 0 days.

(21) Appl. No.: 12/896,478

(22) Filed: Oct. 1, 2010

(65) Prior Publication Data

US 2011/0280645 A1 Nov. 17, 2011

Related U.S. Application Data

(60) Provisional application No. 61/345,551, filed on May 17, 2010.

(51) Int. Cl.
*B65H 9/16* (2006.01)

(52) U.S. Cl. ..... 271/251; 271/274; 271/34

(58) Field of Classification Search ..... 271/274, 271/273, 34, 251
See application file for complete search history.

(56) References Cited

U.S. PATENT DOCUMENTS 3,981,493 A * 9/1976 Klappenecker et al. ... 271/10.05
3,988,017 A * 10/1976 Kyhl ..... 271/111
3,988,019 A * 10/1976 Achelpohl ..... 271/180
4,214,744 A * 7/1980 Evans ..... 271/202
4,426,073 A * 1/1984 Mizuma ..... 271/251
4,691,913 A * 9/1987 Frank ..... 271/34
4,775,142 A * 10/1988 Silverberg ..... 271/251
5,275,395 A * 1/1994 Boggiano et al. ..... 271/259
5,390,909 A * 2/1995 Herrick, Jr. ..... 271/251
5,511,774 A * 4/1996 Lyga ..... 271/273
5,575,465 A * 11/1996 Auerbach et al. ..... 271/9.13
6,561,507 B1 * 5/2003 Pollock ..... 271/182
6,698,746 B2 * 3/2004 Buck et al. ..... 271/9.04
6,776,409 B2 * 8/2004 Cook ..... 271/189
6,966,711 B2 * 11/2005 Miller et al. ..... 400/55
7,559,831 B2 * 7/2009 Umeda ..... 453/11
8,104,766 B2 * 1/2012 Hara ..... 271/273
8,226,082 B2 * 7/2012 Seiler ..... 271/149

* cited by examiner

*Primary Examiner* — Prasad Gokhale

(74) *Attorney, Agent, or Firm* — Patricia M. Mathers

(57) ABSTRACT

A print media feed system for media of variable thickness having a slanted loading platform with drive wheels to direct print media to a feed zone having a belt system and hanging friction wheels to draw out single print medium of varying thickness and feed the medium to a print zone for a ink jet, laser or other printer wherein the print zone includes a floating deck to maintain a constant clearance distance between the printhead and the print medium.

17 Claims, 19 Drawing Sheets

VARIABLE MEDIA FEED SYSTEM AND PRINTHEAD APPARATUS

This application claims the benefit of U.S. provisional application No. 61/345,551 filed May 17, 2010 and entitled Variable Media Feed System and Printhead Apparatus which is hereby incorporated herein by reference in its entirety.

FIELD OF THE INVENTION

The present invention relates to a print and media feed system for media of variable thickness and in particular to an apparatus which can feed and print media of variable thickness without shingling, i.e. feeding two separate media stacked or partially stacked, to a print zone of an ink jet, laser jet or other printhead and where the apparatus accounts for varying media thickness supplied consecutively to the printhead without movement of the printhead itself.

BACKGROUND

Printers for media generally include a printhead within a print zone where media is fed into alignment beneath the ink nozzles, jet or sprayers of the printhead. The media to be printed for example a postal code or stamp to be printed on a #10 envelope or envelopes of varying thicknesses, are provided in a loading area and are supplied through the print zone one at a time to a printhead where print indicia such as a cancellation stamp can be applied by the printhead to the appropriate portion of the media. The printhead can be any kind of ink or laser jetting printing assembly. The printhead generally includes a plurality of ink emitting nozzles from which a selected color ink is jetted or adhered to the media. Print quality is improved if the print media is allowed to be as close as possible to the printhead. The clearance distance between the front side control surface of the print media and the print nozzles is critical because all ink jetting printheads exhibit a certain amount of spray as small stray drops of ink are ejected slightly off trajectory from the main drop. If the distance between the front side control surface of the print media and the ink jetting nozzles is small, stray ink drops are minimized.

However, the clearance distance between the ink jetting nozzles and the front side of the print media can only be minimized to a certain extent. If the clearance distance is too small, waving in the print media caused by wet ink may cause the front side of the print media to touch the printhead in the area of ink jetting nozzles. When the print media is touching the printhead, the ink drops of course cannot be properly jetted on the front side thereof for formation of a print image. If the media is too far away from the printhead there will of course be blurring and overspray from the printhead nozzles.

Conventional systems which control the clearance distance between the print media and the printhead are of two basic types. The first type uses a back side control surface which is disposed at a predetermined distance away from the printhead. The print media is forced against the back side control surface. The distance between the front side control surface and the printhead thus varies depending on the thickness of the print media. Since the back side control surface is fixed, the clearance distance between the front side of the print media in the printhead must be sufficiently large such that the print media will not contact the printhead as described above. Decrease in clearance distance to improve print quality may result in the print media contacting the printhead which is not desirable as described above.

The second general type of system used to control the clearance between the print media and the printhead biases the print media against the front side control surface as opposed to the backside control surface. The front side control service may either be movable in transverse directions along with the printhead, or be fixed and extend across the width of the print media. In either event, the clearance distance between the edge of the front side control surface and the print media is fixed and does not change regardless of the type of print media used during printing.

For example, U.S. Pat. No. 5,648,807 (Saito et al.) discloses an inkjet printer (FIG. 3A) having a paper feed roller 330 which is engaged by a pinch roller 350. Pinch roller 350 is rotatably attached to the distal end of the paper guide 53 which is suspended from a rear, fixed frame 130 using a spring 52 so that paper guide 53 rotates about a fulcrum point 51. Frame 130 not only interconnects with the paper guide 53 but also substantially forms an enclosure which carries the plurality of gears, rollers etc. (FIG. 18). As shown in FIG. 27 a lower end of the rear frame 130 is attached and carries a pressing member 140 which is disposed above feed roller 330. Because of the fixed nature of frame 130, pressing member 140 is always "located at a slightly lower position from a tangent T to both feed roller 330 and transport roller 381, and is arranged to press paper P downward." Because of the fixed and immovable nature of frame 130 and pressing member 140, pressing member 140 does not move with or relative to pinch roller 350 carried by paper guide 53, but rather is fixed in a stationary position.

As a further example, U.S. Pat. No. 6,089,773 discloses a media feed system for an inkjet printer used to control the distance of the media from the printhead. Four deflector plate assemblies 22 (FIGS. 1-4) are successively arranged across the width of the print medium. Each deflector plate assembly 22 includes an elongate base 34, at least one metering roller 36 and at least one deflector plate 38. An extension 40 of the elongate base 34 is attached to a tension spring 42 that biases the elongate base 34, metering rollers 36 and deflector plate 38 towards the feed roller 20. Each metering roller is positioned in association with and defines a nip 50 with feed roller 20 through which print medium 12 passes. "Print medium 12 is engaged by feed roller 20 and is carried though nip 50 formed with metering rollers 36. Metering rollers 36 and deflector end 46 of deflector plate 38 are moved away from feed roller 20 a gap distance (not numbered) which is associated with the thickness of print medium 12. Depending upon the force applied by tension spring 42, metering rollers 36 may slightly compress print medium 12 such that the gap distance is slightly less than the thickness of print medium 12. Likewise, the compressive force applied to print medium 12 in nip 50 by metering rollers 36 may result in a slight cupping of feed roller 20, depending upon the material from which feed roller 20 is constructed." Either result may be poorer quality print reproductions or damage to the print media. What is particularly needed in the art is a media feed system which overcomes the problems associated with fixed front side and back side media control surfaces and which can account for variable thickness media within the same printing run.

SUMMARY OF THE INVENTION

The print and media feed system and apparatus of the present invention uses one or more angled nudger wheels within a slanted feed platform to allow stacked print media of different thicknesses to drop within a feed zone to be separated and fed individually into the printing assembly. The slanted platform may be between 15° and 30° to allow gravity to assist in stacking of the print media along the platform and assist the nudger wheels where the angled nudger wheels perform both the duties of assisting in the stacking of the media in an x-direction, and directing along a y-direction the media further into the feed zone. In sliding or dropping within the feed zone the print media may be stacked where one or more print media is partially or completely supported on top of other print medium. As the individual media drop toward the bottom of the stack, the print media is directed to a first set of one or more friction wheels straddling a set of feed belts where the belts in conjunction with the friction wheels draws each piece of individual media farther along the feed zone.

The feed belts may be extended between two rollers that are in parallel and extend perpendicularly to the feed platform. Each roller may be attached to a motor within a housing to rotate the feed belt. The friction wheels are affixed to a pendulum shaft and cantilever support extending perpendicularly to the slanted platform and above the feed belts. A tensioning screw allows the amount of swing of the pendulum shaft to be adjusted with the tip of the friction wheel adjusted to the plane of the slanted platform. As the stack of print media is drawn into the feed belts and friction wheels, a single piece of medium begins to separate from the stack of media. The media is then fed into a second set of feed belts and friction wheels with the feed belts of the second set rotating twice as fast as the feed belts of the first set pulling the single piece of print medium separated by the first set of belts and wheels out of the stack and in to a printing apparatus.

The friction wheels of each set are tensioned on a spring biased pendulum to compress the print media to the surface of the slanted platform and allow the belts to extract and separate the single print medium from the print media stack. This is generally referred to as singulation, i.e. singling of each media element from the stack. The pendulum shaft and friction wheel swings to a greater extent as print medium of a greater thickness is drawn into each set of feed belts, than for medium of lesser thickness. However in swinging the friction wheels on the shaft still tightly compress against the medium, allowing the thicker medium to fit through and be drawn out of the stack of print media. The print media may be smaller #10 envelopes, or larger document package envelopes of standard or non-standard sizes.

The single print media is fed from the high speed feed rollers to the print zone of the printing apparatus. Within the print zone, the slanted printhead is suspended above a slanted floating deck assembly with a deflector plate suspended below the printhead to direct the print medium to the floating deck. The deflector plate is aligned with and at a minimal distance from the slanted feed platform. The print medium is directed below the deflector plate on to the slanted floating deck assembly. The floating deck is normally compressed against the deflector plate therefore as print media of different thicknesses are fed on to the floating deck, the deck is moved at that thickness away from the deflector plate compressing the media against the defector plate and the print head thereby maintaining a constant clearance distance between the printhead and the print media.

It is an object of the present invention to direct print media from a feed zone to a print zone where ink is jetted or otherwise introduced to the surface of the media.

It is another object of the present invention to provide a feed system that accepts a single stacked batch of various thicknesses of media including envelopes, packages or other printable documents and media of different thicknesses and facilitates delivery of singulated media into the print zone to be printed.

It is yet another object of the present invention to prevent shingling, i.e. the sticking together or stacking of media as the media is fed into the print zone by using a variable size nip to accommodate different thicknesses of media during the transport of the media to the print zone.

It is still another object of the present invention to provide media feed belts running at different speeds and friction wheels operating in conjunction with the feed belts to define the variable size nips, where the friction wheels hang from a pendulum shaft above and between the feed belts to separate stacked or shuffled print media prior to transport into the print zone.

It is another object of the present invention to provide a floating deck having a two dimensional range of motion within the print zone to allow for printing of media of different thicknesses without movement of the printhead.

It is a still further object of the present invention that the floating deck defines a neutral spacing from the printhead assembly and is adjustable towards and away from the printhead to allow print medium of various thicknesses to align relative to the print head.

It is another object of the present invention that media of varying thicknesses are consecutively transported and printed using a printer apparatus that maintains a consistent clearance distance between a top surface of the media and the printhead of the apparatus.

The present invention is directed to a media feed apparatus for singulating a plurality of stacked media comprising, a load zone for receiving the plurality of stacked media; a feed zone for singulating the plurality of stacked media, the feed zone comprising a first set of transport belts for transporting the media through the feed zone; a second set of transport belts receiving the transported media from the first set of rotating belts; and a first friction element rotatably suspended above the first set of transport belts defining a first singulating nip and a second friction element rotatably suspended above the second set of transport belts defining a second singulating nip.

The present invention is also related to a method of singulating a plurality of stacked media comprising the steps of providing a load zone for receiving the plurality of stacked media followed by a feed zone for singulating the plurality of stacked media; transporting the media through the feed zone on a first set of transport belts; receiving the transported media on a second set of transport belts subsequent to the first set of transport belts; and rotatably suspending a first friction element above the first set of rotating belts to define a first singulating nip and rotatably suspending a second friction element above the second set of transport belts to define a second singulating nip.

The present invention is further related to a print media feed system for media of variable thickness to feed a printer apparatus comprising a load zone for loading printable media; a plurality of nudger wheels supported on a shaft situated below the load zone; a plurality of low speed transport belts situated in a feed zone having a plurality of rotatable friction elements pivotable about an axis positioned above the transport belts; a plurality of high speed transport belts situated in the feed zone subsequent to the low speed transport belts also having a plurality of rotatable friction elements pivotable about an axis positioned above the high speed transport belts; and wherein the nudger wheels direct print media in a direction different from a media transport direction dictated by the high and low speed transport belts.

These and other features, advantages and improvements according to this invention will be better understood by reference to the following detailed description and accompanying drawings.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION OF THE INVENTION

Figure 1A:
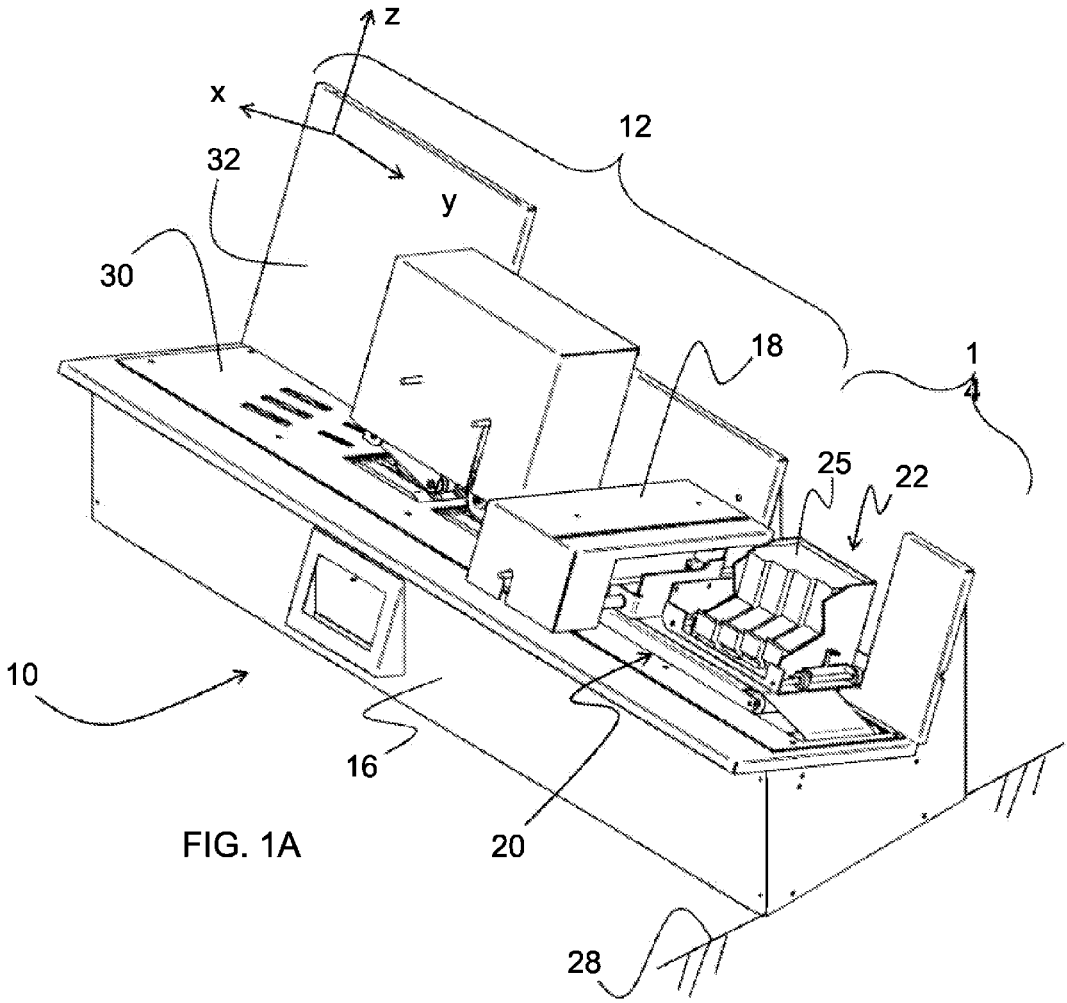
FIG. 1A is a perspective view of a first embodiment of the variable media feed system and printhead apparatus.

Referring now to FIG. 1A, a first embodiment of a variable media feed system and printhead apparatus 10 for feeding variable thickness print media through a feed zone 12 to a print zone 14 where ink is jetted or otherwise introduced to the surface of the media. The feed system and printhead apparatus 10 comprises in general a base housing 16 which includes the feed and media alignment components of the feed system and printhead apparatus 10. The feed system includes a feed zone 12 with a plurality of media handling wheels, belts and rollers described in further detail below, leading to a media sensor 18 and then subsequently to a printhead 22 in the print zone 14. Besides the printhead 22, the print zone 14 includes a floating deck 20 to accommodate varying thicknesses of media below the printhead 22. For example the printhead 22 may be a cancellation stamp printing mechanism for repetitive printing of cancellation markings on a mail stamp affixed to each of the individual media which might be variably sized envelopes or other folded media. It is to be appreciated that the media feed system and printing apparatus of the present invention is not limited to stamp cancellation, nor merely mail or postal services, but may be utilized in almost any printing application or field and includes almost any type of indicia which may be printed on almost any imaginable media.

Figure 1B:
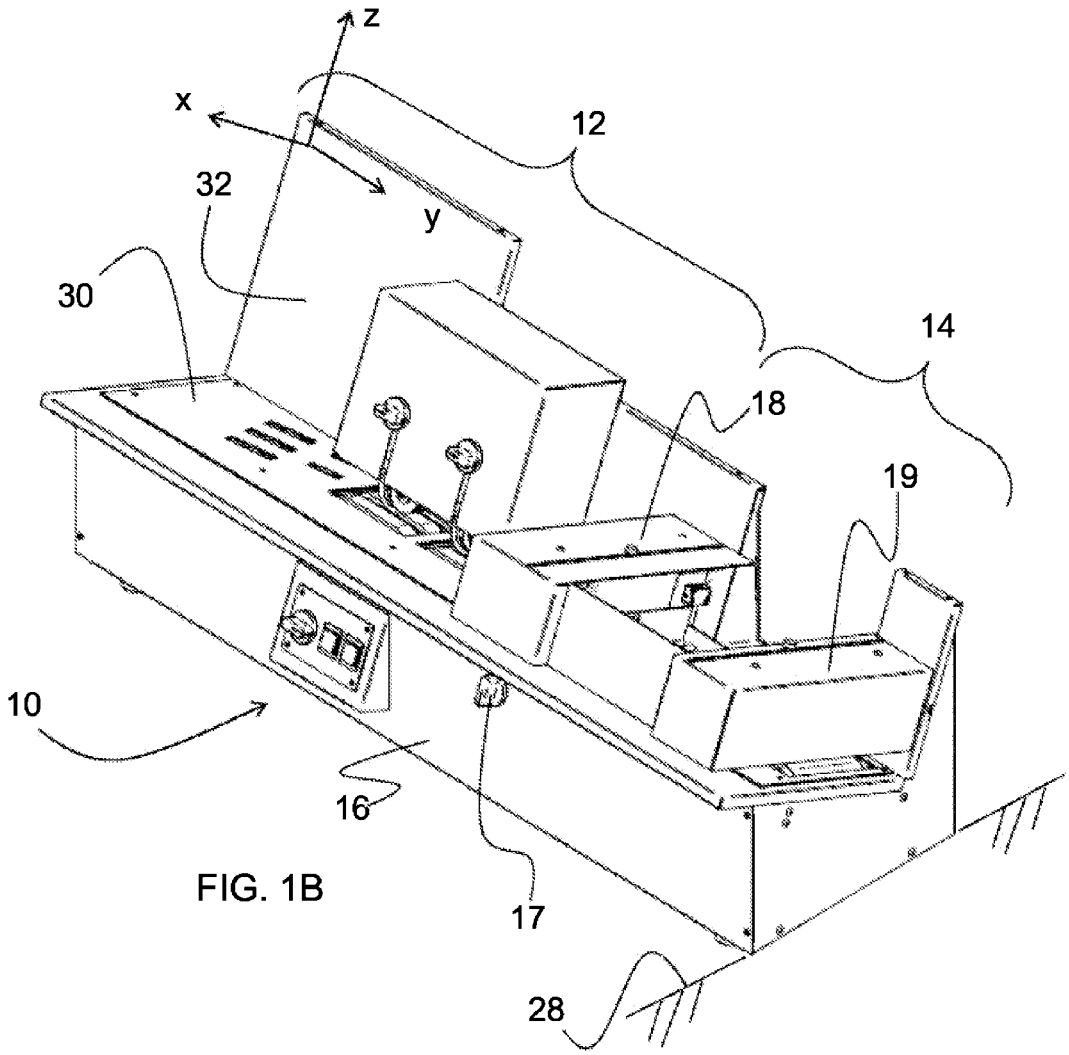
FIGS. 1B-C are a perspective and front elevational view of a second embodiment of the variable media feed system and printhead apparatus without a printerhead.
Figure 1C:
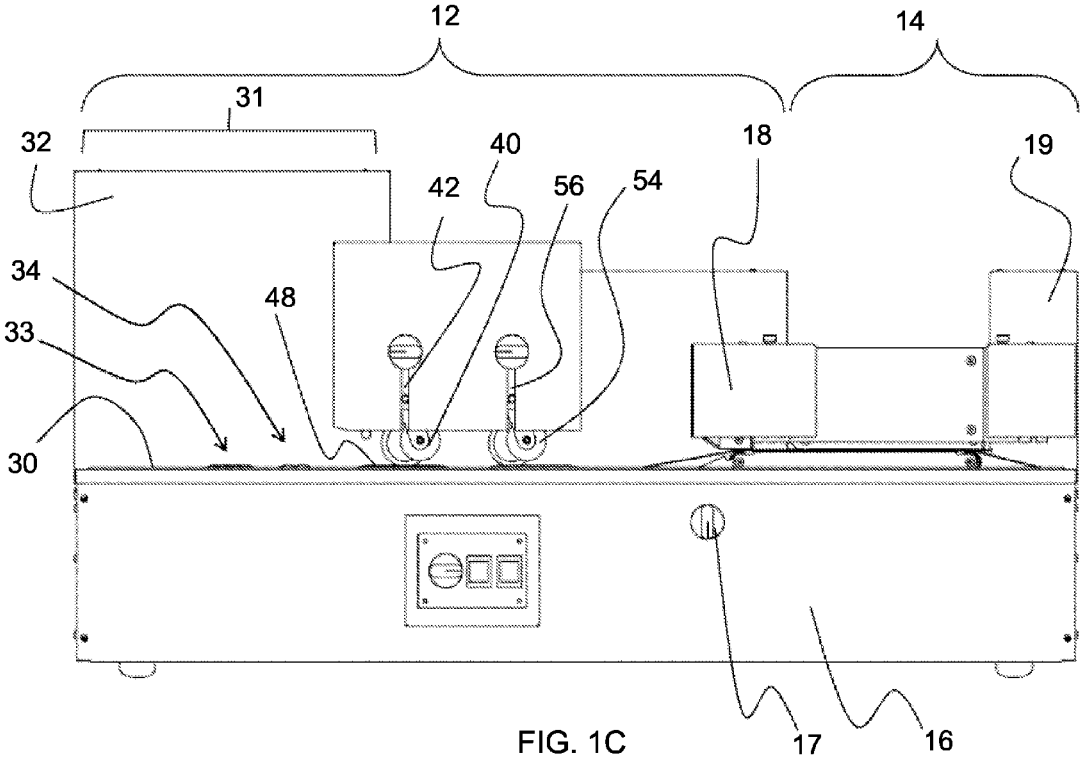

FIGS. 1B and 1C shows another embodiment of the present invention without the printhead 22 positioned in the apparatus and having an additional sensor or camera housing 19 following the space in which the printhead 22 is generally mounted. This embodiment shows that a number of various devices such as printers, cameras, media and system sensors may be utilized as cooperating components in conjunction with the feeding and printing system and the floating deck 20 as described in further detail below.

Figure 2:
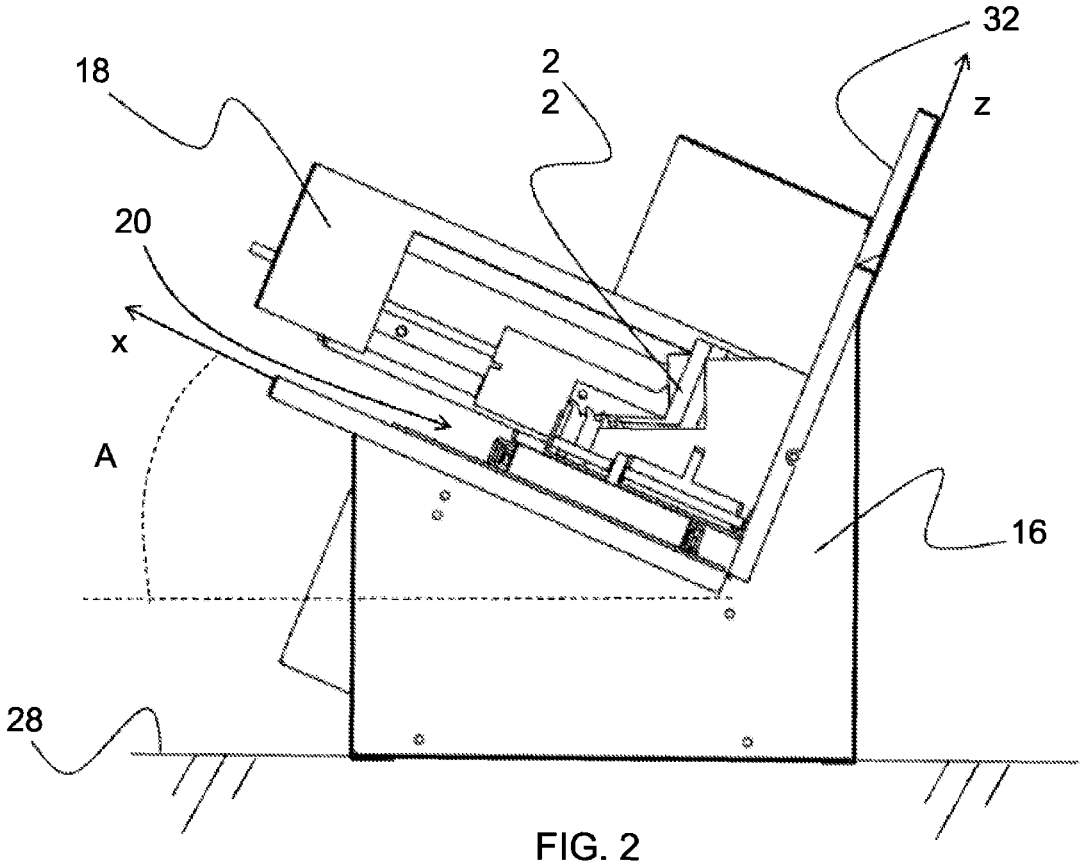
FIG. 2 is a side view of a first embodiment of the variable media feed system and printhead apparatus showing the slanted feed platform.

As seen in FIGS. 1A and 1B and in the side elevation view of FIG. 2, the base housing 16 is supported on a horizontal support surface 28 such as a table or platform, and provided with a feed surface 30 which is slanted or angled relative to the horizontal support surface 28 at an angle A of between about 10 and 40 degrees and preferably about 20-30 degrees along its length. The angle A is transverse to the movement vector of the media through the feed system to facilitate alignment of the media in the feed system. The feed surface 30 supports media on an x-y plane defined by the feed surface 30, and the media is stacked in a substantially vertical manner along a z-axis intersecting the x-y plane. In the feed zone 12 the lowermost media is extracted from the stack and passed across the feed surface 30 to the print zone 14 along the x-y plane and in the y-axis direction which essentially defines the movement vector of the media. A stop wall 32 is connected substantially perpendicularly relative to the feed surface 30 and defines the y-z plane to provide a top edge alignment for all the print media being processed. The stop wall 32 in cooperation with angle A maintains the top edge of all the media along the stop wall 32 in the y-z plane so that consistent alignment of the media in each of the x, y and z directions is maintained and the media is therefore presented to the print zone 14 and print heads at the appropriate time and position. The angle A of support surface 30 permits gravity to assist in the top edge alignment of the media along the y-z plane both during the stacking arrangement in the beginning of the feed zone 12 and as each individual media piece is consistently extracted from the stack and pulled across the support surface 30 through the feed zone 12 in the y-axis direction.

Figure 3A:
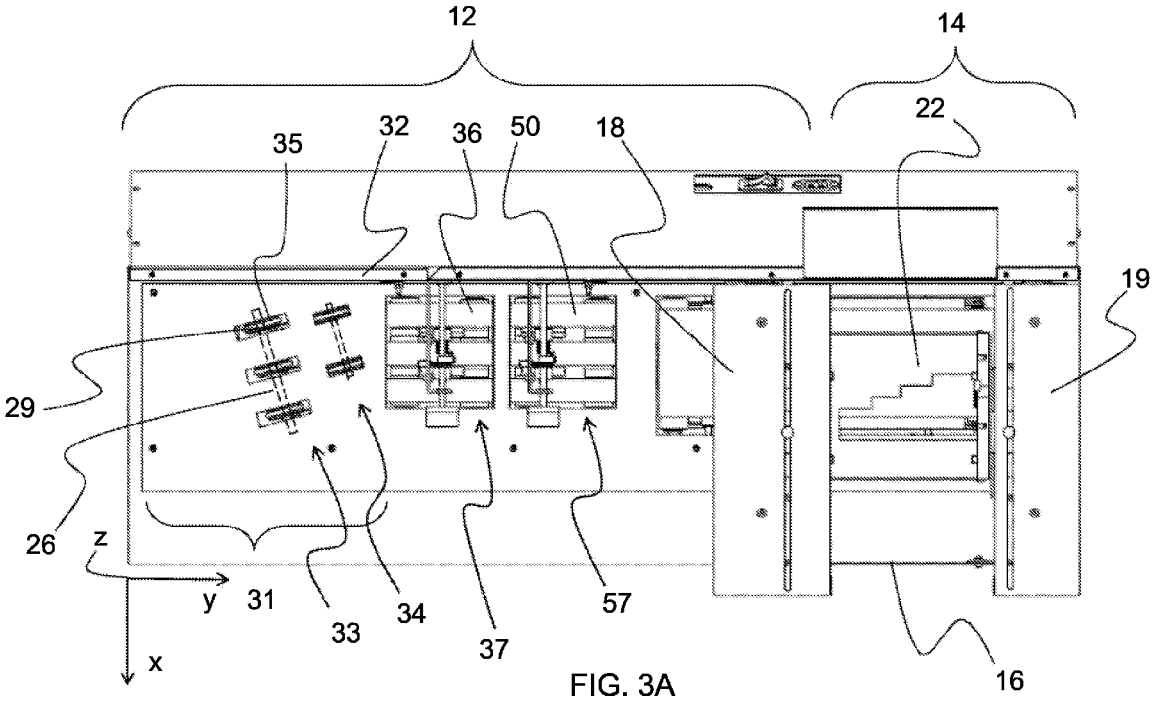
FIG. 3A is a top planner view of the variable media feed system showing the feed zone and print zone.
Figure 3B:
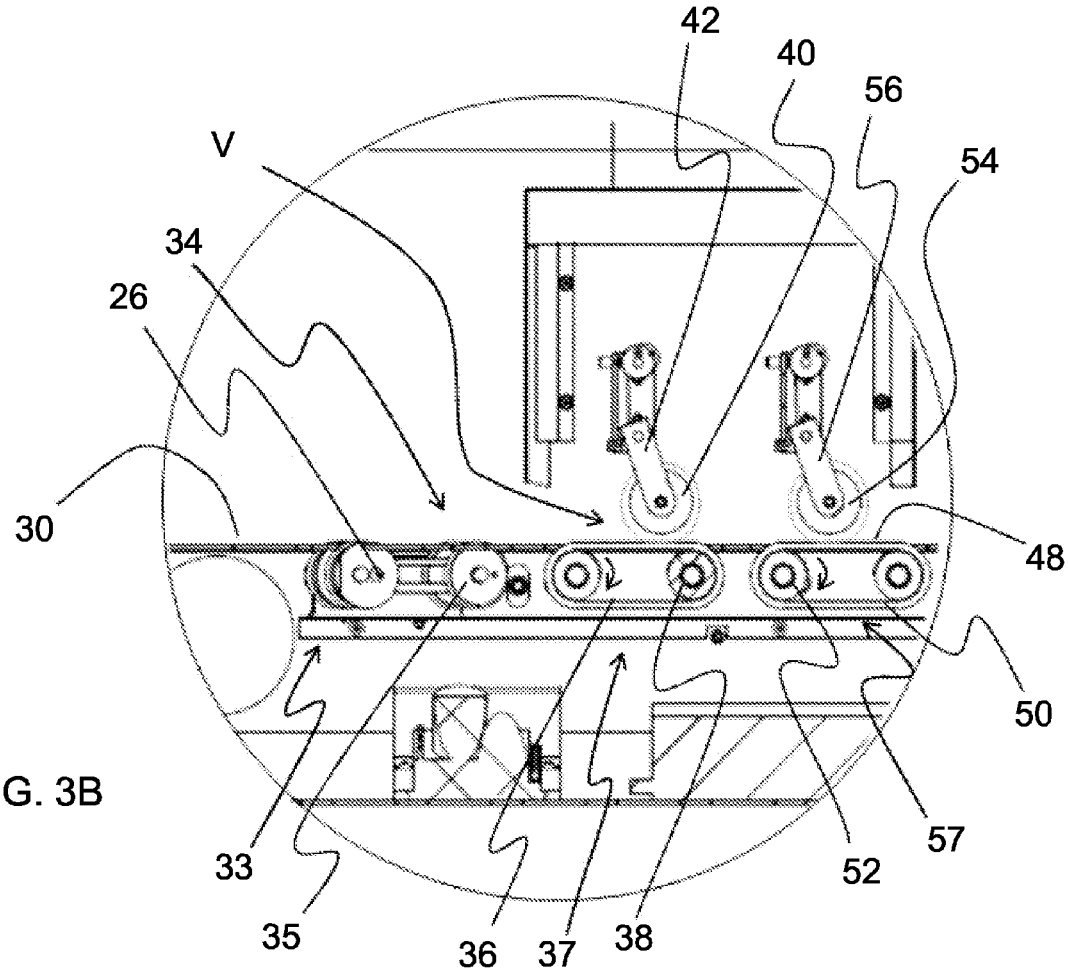
FIG. 3B-C is a cross-sectional view of the drive and nudger wheel assembly as well as the friction wheels of an embodiment of the variable media feed system.

As shown in FIGS. 3A and 3B, the loading area 31 is provided with a plurality of nudger wheels 33 and drive wheels 34 which are supported on shafts below and in parallel alignment with the support surface 30. The support surface 30 has a passage for each nudger wheel 33 and drive wheel 34 which permits a portion of the nudger wheels 33 and the drive wheels 34 to extrude above the x-y plane defined by the support surface 30. In this way the nudger and drive wheels 33, 34 which initiate the extraction of the lowermost media in a stack of media within the area, cause the media to be pushed out from under the stack and into the feed zone 12 for collating and eventual introduction to the print zone 14.

Figure 3C:
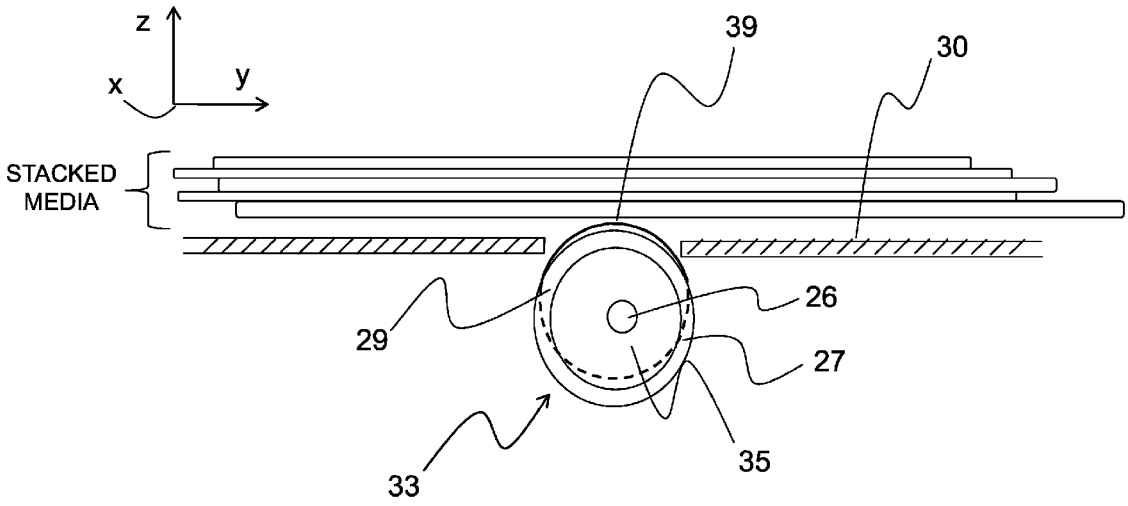

The nudger wheels 33 have a circumferential media pulling portion 35 shown in FIG. 3C which pulls the lowermost media out from a stack, and also a cam-shaped or radially off-set plate 29 which defines a radially extending section 39 of the nudger wheel circumference which extends radially beyond the circumferential media pulling portion of the nudger wheel 33 so that as the nudger wheel 33 rotates, there is a portion of the circumference of the nudger wheel 33 which extends higher in the z-axis direction above the plane of the supporting surface 30, and higher than the circumferential media pulling portion 35 to raise the entire stack of media in the z-axis direction as supported in the loading zone 31 for a very short period of time. This is so that the media is at least partially frictionally disengaged from contact with circumferential media pulling portion 35 of the nudger wheel 33 so that the stacked media jostles and is free to slide in the x-axis direction towards and so aligns with the stop wall 32. Different from the circumferential media pulling portion 35 of the nudger wheel 33, the radially extending section 39 of the radially offset plate 29 may not have a high friction o-ring 27 on the surface of the plate so that it does not pull as much on the lowermost media in the stack. This may also provide some time separation between each individual piece of media being pulled from the stack. The periodic undulating motion and jostling of the stacked media caused by the nudger wheels 33 thus aids particularly in the y-z alignment of the stacked media against the stop wall 32 in the load zone 31.

Figure 4:
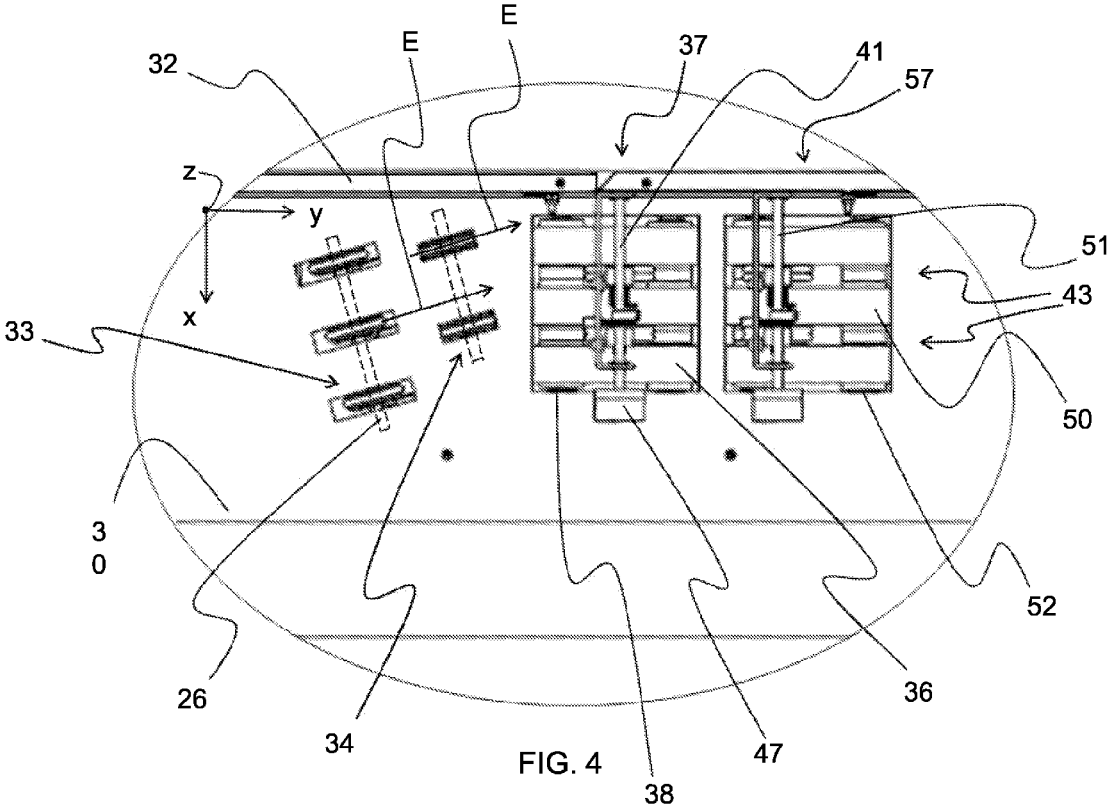
FIG. 4 is a top planar view of the loading and feed zone of one embodiment of the variable media feed system.

The nudger and drive wheels 33, 34 are also angled by alignment of their supporting spindle or axle 26 in the x-y plane so that the direction of extraction E of the lowermost media in the stack of media provided by the drive wheels 33 is not entirely parallel with the y axis, but actually includes components of both the x-y axes as shown in FIG. 4 by the dashed line indicating the alignment of axle 26. This drives the lowermost media, and hence to some extent the media stacked above it, in both the x-axis direction towards the stop wall 32, and also in the y-axis direction into the feed zone 12. This again facilitates the alignment of the top edge of the media against the stop wall 32 as the media is moved into and through the feed zone 12 along the y-axis vector towards the printing zone 14.

Following the load zone 31 where the media is stacked and drawn in the y-axis direction along the apparatus to the feed zone with the nudger and drive wheels 33, 34, a first set of a plurality of laterally spaced apart pulley belts 36 are situated in respective openings in the support surface 30. As seen in FIG. 3B, the top surface of these belts 48 are substantially parallel with and spaced slightly above the support surface 30 and rotating, here in a clockwise direction relative to the drawings, to engage the bottom side of the media to draw and propel the media along the feed zone 12 for singulation and printing. Each pulley belt 36 of the first set has a component which is rotating above the plane of the support surface 30 in such a manner so as to draw the media along a y-axis vector towards the print zone 14. In the present embodiment there are two sets of pulley belts shown, the first set 37 having low speed feed rollers 38 that are powered by a motor assembly (not shown) within the base housing 16 and a second pulley set 57 having higher speed feed rollers 52 which may rotate at 1.5 to 3 times faster than the first set 37, but preferably at about 2 times as fast as the first set 37. This speed difference is important because the faster set 57 accelerates the lowermost media in direct contact with the faster pulley belts 50 quicker than any shingling media being retarded by the friction wheels 54 and thus helps singulate and separate each piece of media. The speed difference between the first and second set can be accomplished by a separate motor for the second set 57 or by a cooperative direct drive and appropriate gear ratio accorded between the first and second pulley sets 37, 57.

Located above the first pulley belt set 37 is a respective set of friction wheels 40 which, in cooperation with the pulley belts 36, facilitate the singulation and transport of the media through the feed zone 12. As seen in FIG. 4, there are longitudinal spaces 43 between each pulley belts 36, 50 from the separation of the belts on the rollers 38, 52. Observing FIG. 5A, the friction wheels 40 associated with the first pulley set 37 are supported at the end of a respective support arm 42 which is supported on a pendulum shaft 41. The friction wheels 40 are free to rotate about their main axes T relative to the support arm 42 and the support arm 42 is itself free to rotate in a springably biased manner controlled by a spring 44 about the axis of the pendulum shaft 41. In their initial or neutral spring biased position the support arm 42 and the friction wheels 40 are maintained by the spring 44 in a substantially vertical alignment and essentially axially parallel with the z-axis. In this position the pendulum shaft 41 and the support arm 42 maintain at least a portion of the outer circumference of the friction wheel 40 between the spaces or valleys 43 created between each belt 36. Importantly, a portion of the circumference of the friction wheel 46 as shown in the diagram of FIG. 5B may be positioned below the top surface of the pulley belt 48. This is important because it helps maintain an upper force bearing on the transported media which forces the media being transported into greater frictional contact with the belts 36, and thus more consistent transportation of the media through the apparatus with less slippage. These friction wheels 40 may freely rotate, or may be driven by a separate motor (not shown) to ensure that a desired amount of friction and pressure to supply a motive force on top of the media to pass the media through the feed zone 12 by the pulley belts 36. In some cases the friction wheels 40 may be driven in a reverse direction from the pulley belts 36 so that any media shingling, i.e. layered on top of a lower media being transferred along the support surface 30, is pushed back in the opposite direction and is not carried through the feed zone 12 to the print zone 14 along with the lower media.

Figure 5A:
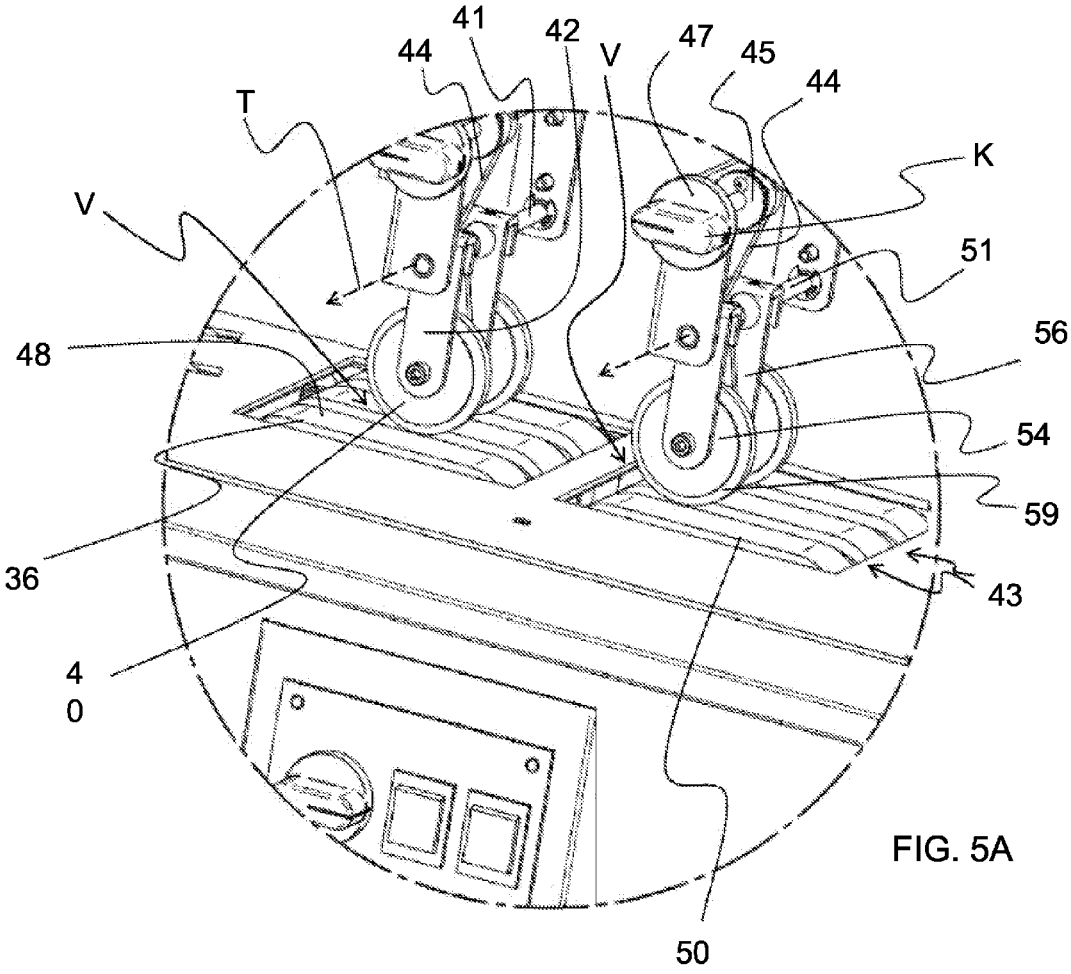
FIG. 5A is a perspective view of the low and high speed belts, the friction wheels and the pendulum shafts of one embodiment of the variable media feed system.
Figure 5B:
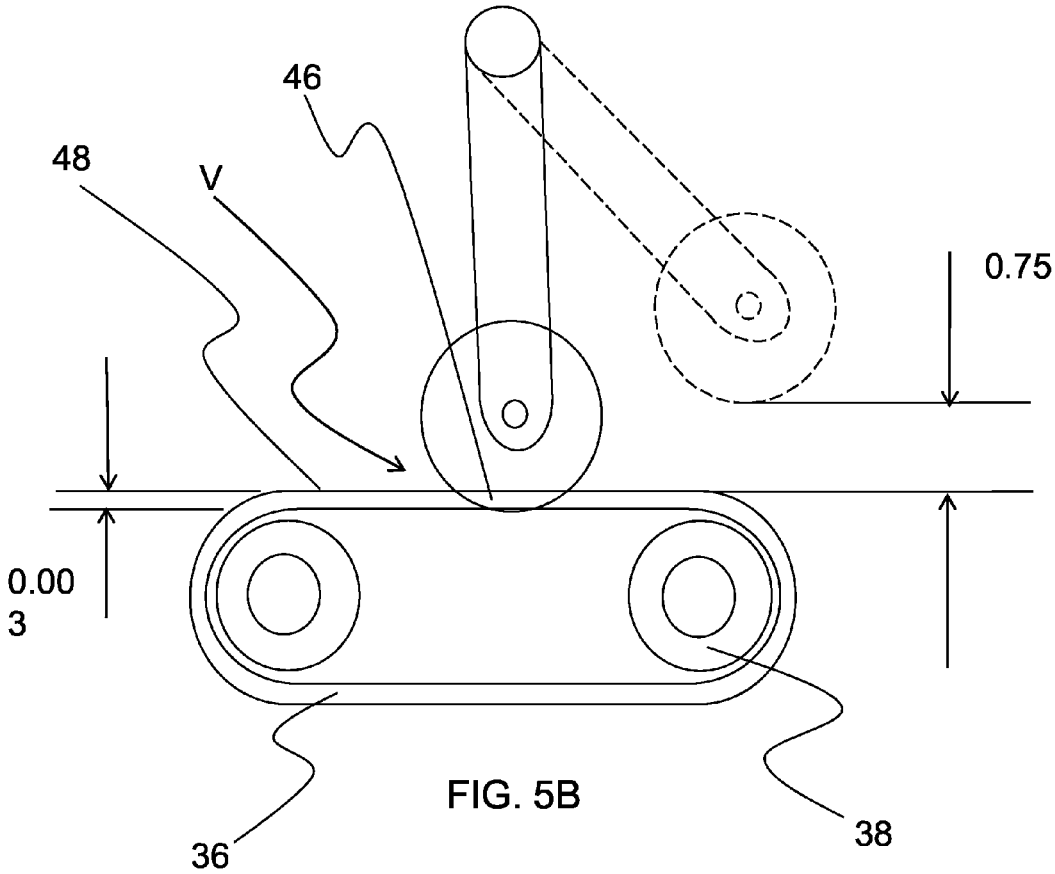
FIG. 5B is a diagrammatic view of the friction wheels and the pendulum shafts of one embodiment of the variable media feed system.
Figure 5C:
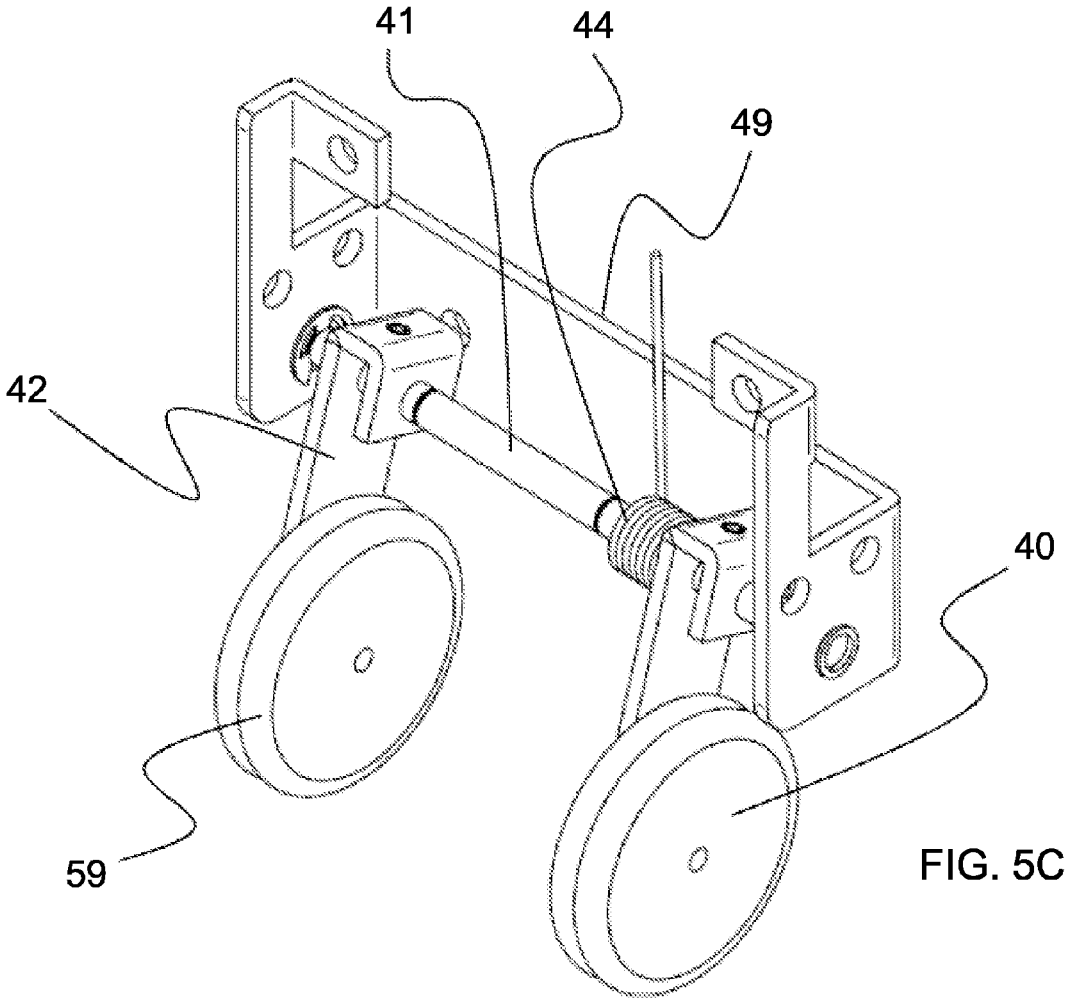
FIG. 5C is a perspective view of the assembled pendulum friction wheel assembly of one embodiment of the variable media feed system.
Figure 5D:
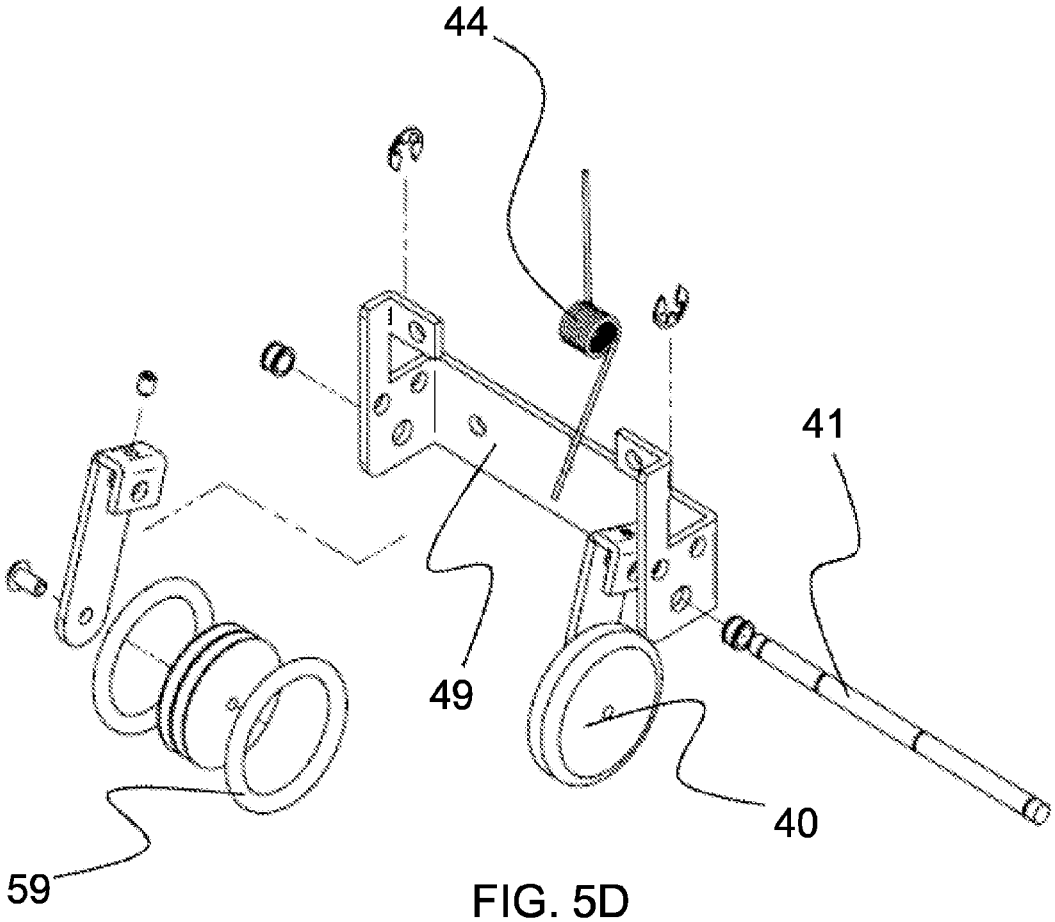
FIG. 5D is an exploded view of the pendulum friction wheel assembly of one embodiment of the variable media feed system.

The friction wheels 40 and the pulley belts 36 define a variable nip V shown in FIGS. 5A and 5B which includes at one extreme the overlap of the friction wheels 40 with the pulley belt 36 and increases within an allowable range so that there is a spacing between the outer circumferences of the pulley belts 36 and friction wheels 40 according to bias of the spring 44 and freedom of rotation of the arm 42 about the axis of the pendulum shaft 41. The variable nip size V is important so that different thickness of media in the same batch can be sent through the feed zone 12 and the nip V can automatically adjust to accommodate the range of media thicknesses, even where each adjacent media piece is different thickness from the preceding and subsequent media piece in the same batch. This automatic variability to accommodate different sized media occurs without a user's intervention or manual adjustment of the nip size during feeding and printing of the entire batch because a thicker media forces the friction wheel 40 and the support arm 42 to rotate about the pendulum shaft 41 raising the friction wheel 40 up and enlarging the nip V to accommodate the thicker media across the pulley belts surface 48. The nip V may range from between about −0.003 inch (i.e. the overlap) to 0.75 inch to handle everything from a single sheet of paper to a 0.75 inch thick envelope. One embodiment of the support arm and friction wheels is shown in FIG. 5C with the support arm 42 and pendulum shaft 41 affixed to a structural bracket 49. An exploded view of this embodiment of the first set of the friction wheel assembly 53 is shown in FIG. 6D. The friction wheel 40 may have one or more o-rings 59 to provide additional grip as media is singulated through the friction wheels 40 and pulley sets 37, 57.

A spring 44 biases the support arm 42 and friction wheel 40 about the pendulum shaft 41. The spring 44, for example a coil spring having an inherent torsional increasing resistance can be used. With such a spring 44 the pressure is accordingly increased by the friction wheel 40 on a top surface of the media as the nip V gets bigger and the coil spring 44 is wound tighter. This increase in pressure assures that even as the nip V gets larger to accommodate thicker media, shingling is reduced or prevented because it becomes more difficult for media riding atop a lower most media on the support surface 30 to get through the nip V. Again, this feature of the present invention not only provides for variable thickness of media, but also helps prevent double feeding and improves singulation of the media through the feed zone 12.

The spring 44 which biases the arm 42 in a substantially vertical position is a coil spring wrapped around the pendulum shaft 41 and having one end abutting the arm and the opposing end of the spring abutting a cam 45 located on a tension adjustment mechanism 47 as shown in FIG. 5A. The tension of the spring 44 can be adjusted by the tension adjustment mechanism 47 to either increase or decrease the spring tension applied to the arm 42. A user can actuate a knob K which rotates the cam 45 to move the second end of the coil spring 44 relative to the first end such that the coil spring is coiled more tightly about the pendulum shaft 41 to increase tension, or alternatively, rotating the knob and hence the cam 45 in an opposite direction so that the spring 44 is allowed to relax towards its neutral position to provide less tension on the support arm 42. This permits the user to adjust the spring tension on the arm 42 for purposes of controlling shingling and the pressure on the media as it passes through the nip V between the pulley belt 36 and friction wheel 40.

In other words, as stacked or shuffled pieces of media in a stacked batch are drawn into the feed zone 12 by the nudger and drive wheels 33, 34 the friction wheels 40 hold the lower most transported media against the support surface 30 and the pulley belt 36 which propels the lowermost media forward while the wheel 40 holds back the riding of vertically adjacent media atop the transported piece to prevent shingling. This is critical in that all the different thicknesses of media from a single loaded media batch are drawn singly into the feed zone 12 and subsequently singly presented to the print head to receive the desired indicia.

Observing FIG. 4 again, the second pulley belt set 57 is similar in many regards to that described above with the exception that the belts 50 of the second set are generally run at higher speed than the first set 37. The set of higher speed feed rollers 52 may be powered by a motor (not shown) within the base housing 16 or a direct gear ratio drive (not shown) from the first pulley set 37. The high speed feed rollers 52 and hence the belts 50, may be operated in one embodiment of the invention in the range of at about 1.5 to 3 times greater than the low speed rollers 38 of the first set and more preferably at about twice the speed of the rollers 38 and belts 36. Located between each of the second set 57 of adjacent pulley belts 50 is a second set of friction wheels 54 disposed in the spaces between each pulley belt 50. The higher speed of the second set of pulley belts 50 allows the lowermost piece of print media that has been drawn out of the stack by the nudger and drive wheels 33, 34 and influenced by the first and second set of friction wheels 40, 54 to be rapidly accelerated from the initial extraction from the stack and propelled quickly through to the sensor 18 and print zone 14. The faster speed of the second set 57 of higher speed feed rollers 52 and belts 50 also facilities singulation of media because the lower most media being transported by the first feed rollers 38 will be accelerated by the direct contact of the second pulley belts 50, at for example twice its previous speed. This is beneficial in the event there is some shingling occurring in the first portion of the feed zone 12, any media layered on top of the lowermost media on the surface 30 will not be in direct contact with the second set of faster belts 50 and therefore not accelerated as fast as the lower media. Thus, the lowermost media is essentially pulled out from under any shingling media as the lowermost media is accelerated by the second set of belts 50 helping to singulate and separate each adjacent media as they advance towards the print zone 14.

Similar to the first set of friction wheels 40, the second set of friction wheels 54 may be rotatably supported on a second support arm 56 and a second pendulum shaft 51. In a further embodiment, these second support arms 56 may be made shorter so that there is less inertia relative to the first support arms 42 in order to allow the second support arms 56 and respective friction wheels 54 to return more quickly to the feed surface 30 as a single piece of media is drawn at an accelerated rate across the second set of faster pulleys and belts 57 and into the print zone 14. This second set of friction wheels 54 and associated pendulum shaft 51 again facilitates the singulation as described above of the media by varying the nip space V and wheel pressure between the friction wheels 54 and the pulley belt 50 dependent upon the thickness of media passing through the nip V. The variable nip space V between the friction wheels 54 and the pulley belts 50 is critical to ensuring that no matter what change in thickness of media is passed along the support surface 30 during the printing of a batch of different sized media the apparatus can accommodate the feeding and printing of such different thickness media without adjustment or interference from the operator.

Figure 6A:
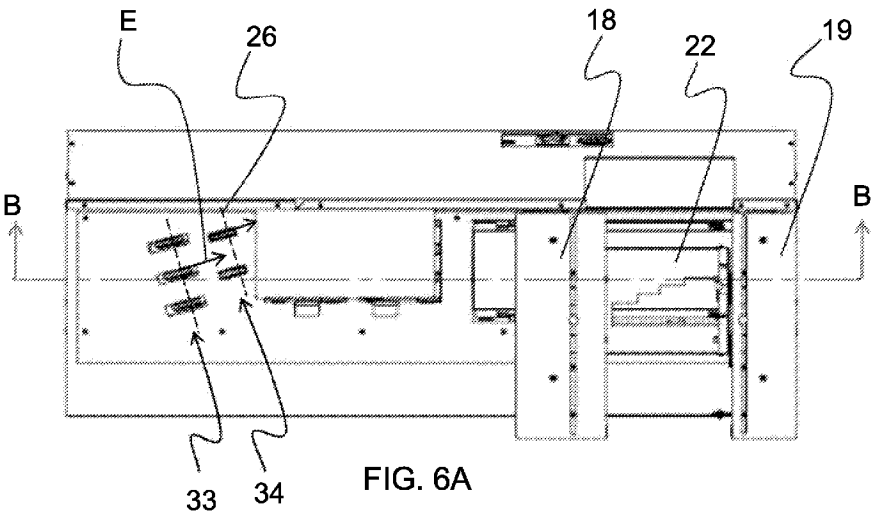
FIGS. 6A-B are a respective top plan view and a cross-sectional view of the variable media feed system and printhead apparatus including the drive and nudger wheels, the low and high speed feed belts, the friction wheels and pendulum shafts of the feed system and the floating deck of one embodiment of the variable media feed system.
Figure 6B:
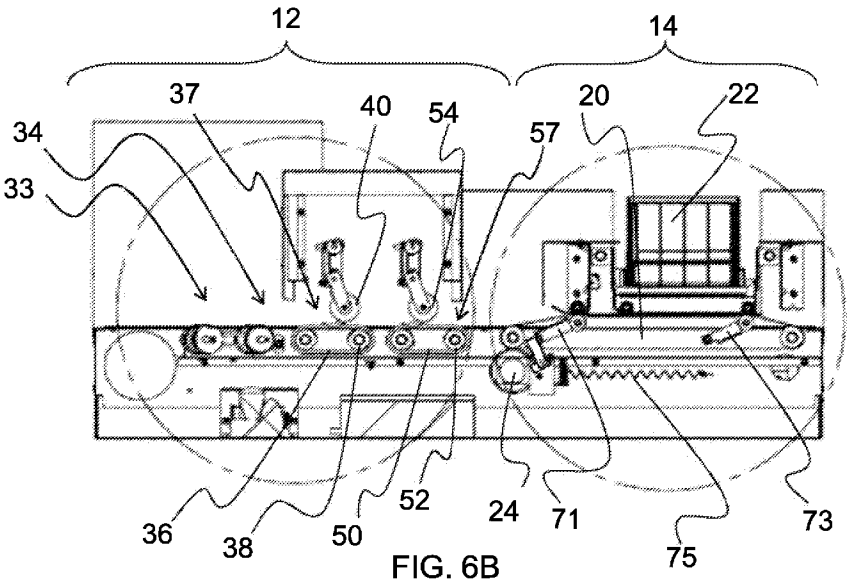

Turning to FIGS. 6A and 6B, between the feed zone 12 and the print zone 14 is a sensor 18 which senses numerous aspects of the media as it passes through the feed and print zones 12, 14. Particularly, the sensor 18 facilitates the timing of the further feeding and presentation of media to the printhead 22 so that media does not overlap and is appropriately timed. The sensor 18 generally senses the time and distance between adjacent pieces of media and can appropriately slow down and speed up the feeding zone process, specifically the nudger and drive wheels 33, 34 and the first and second set of rollers 37, 57 when necessary. Also, an encoder 24 is located adjacent a rotating feed belt 70 which senses the belt speed and communicates with the printer and/or other camera and sensor components to ensure that the timing of the belt 70 corresponds with the media fed to the printer zone and into a position under the printhead 22 so that the printing is appropriately timed and in the correct position on the media.

In one embodiment, following the feed zone 12 and the sensor 18, the media is presented to the print zone 14 which includes the floating deck 20 positioned below the ink nozzle or ink jet assembly 25 of the printhead 22 as shown in FIG.

7A. As media of different thicknesses are drawn into the print zone 14, the floating deck 20 automatically adjusts in a two-dimensional vertical and horizontal manner relative to the printhead 22 to accommodate the thickness of the media and maintain proper clearance distance S between the printhead 22 and a top surface of the media upon which printing is supposed to occur. Maintaining the clearance distance S between the top surface of the media and the printhead 22 is critical because in order to properly print on the media, this distance S must remain consistent no matter the thickness of the media.

The floating deck 20 comprises a media supporting cantilevered deck platform 64 over which a feed belt 70 runs to receive the media from the sensor 18 and transport the media to the appropriate position below the printhead 22. The deck platform 64 is hingedly supported at a front end by a spring biased front support lever 71 and a ramp portion 72 which is planar angled relative to the deck platform 64 to facilitate the transport of the media onto the floating deck 20 and under the printhead 22. A back end of the deck platform 64 is hingedly supported by a spring biased rear support lever 73, so that the front and rear support levers 71 and 73 effected by the spring 75 biases the deck platform 64 and the feed belt 70 in an upwardly biased alignment towards the printhead 22. This two-dimensional "float" or ability of the floating deck 20 to adjust relative to the printhead 22 is important so as to maintain the appropriate distance S of the media from the printhead 22. A diagrammatic representation of the floating deck 20 and corresponding range of motion is shown in FIG. 7B.

Figure 7A:
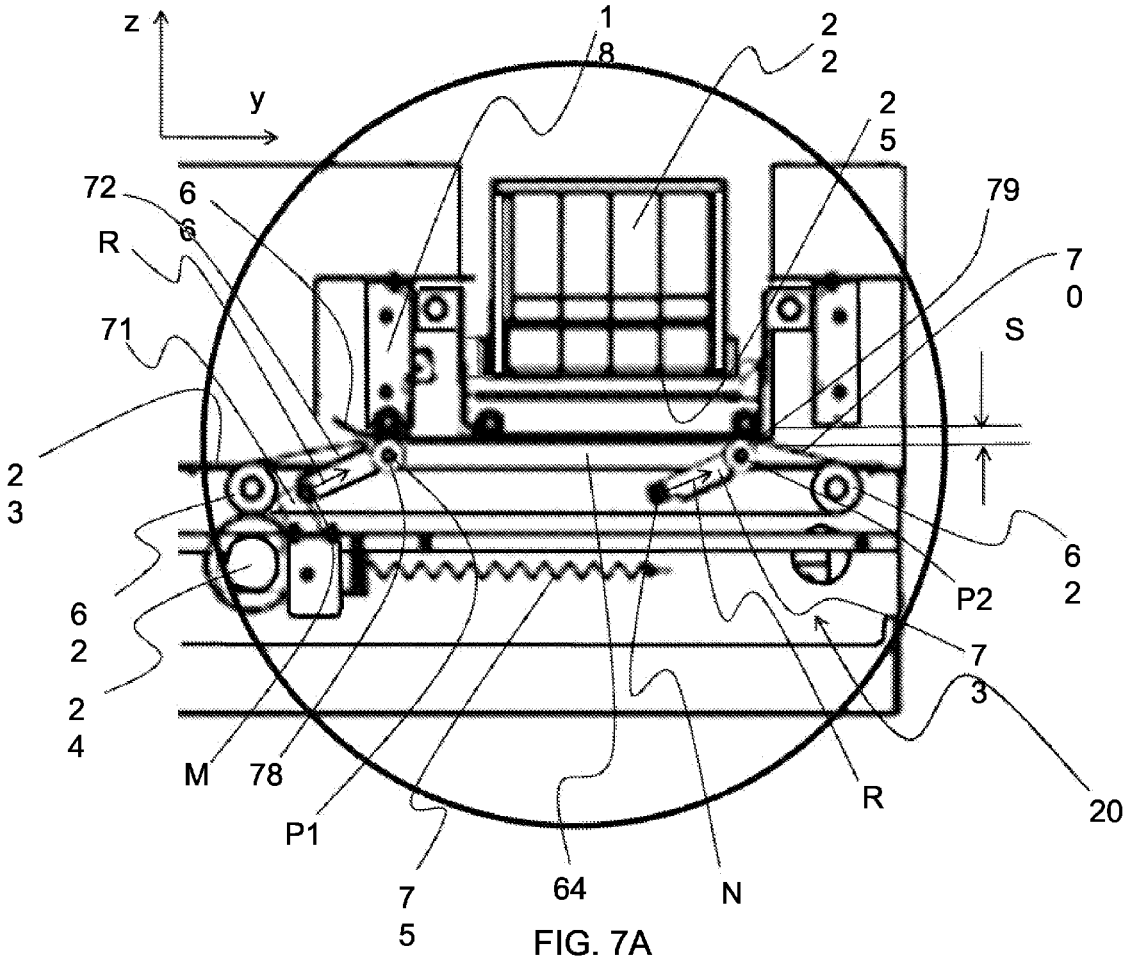
FIG. 7A is a cross-sectional view of the floating deck of the printhead apparatus of one embodiment of the variable media feed system.

Rollers 78, 79 may be positioned at the front and back end of the deck platform 64 where the front and rear support levers 71, 73 connect and pivotably support the deck platform 64 at axes p1, p2. A front roller 78 is positioned with its axis aligned in parallel to the deck platform 64 and the ramp portion 72, and with an outer portion of the roller 78 circumference exposed relative to the deck platform 64 and ramp portion 72 to facilitate the feed belt 70 rotating up the ramp 72 and over the floating deck 20 to bring media onto the floating deck 20. A rear roller 79 is similarly disposed at the back end of the deck platform 64 to ensure the feed belt 70 passes easily over the pivot connection between the back end of the deck 64 and the rear support lever 73. The front and rear rollers 78, 79 may be provided as shown in FIGS. 7A and 7B with their axes concentric with the pivot axes p1, p2 defining the pivotable connection between the front and rear support levers 71, 73 and the deck platform 64.

The front support lever 71 is shown here as an L-shaped member provided with a main axis of rotation M about which two arms of the support lever are rotated to affect the vertical adjustment of the deck platform 64. It is to be appreciated that the lever 71 does not have to be L-shaped, but can be linear, or have additional arms as well. The important part of the lever 71 is that one arm supports the floating deck 20 in a cantilevered and vertical manner relative to the axis of rotation M of the lever 71. In other words, the pivot axis p1 connecting the lever arm and deck 20 is located radially spaced horizontally and vertically from, and above, the relative height of the main axis M. This provides that the axis p1 and hence the arm have a rotational component comprising both a vertical and a horizontal vector component in its movement as the lever arm rotates about its main axis M. Similarly, the rear support lever 73 has a main axis N, spaced vertically and horizontally from the rear axis p2. A spring biasing element 75 may connect the front support levers 71 to an anchor point, or the levers 71, 73 may both be spring biased by individual spring elements having a same or similar spring constant, to maintain the levers 71, 73 and hence the deck 20 in a desired spring biased position relative to the printhead 22.

Figure 7B:
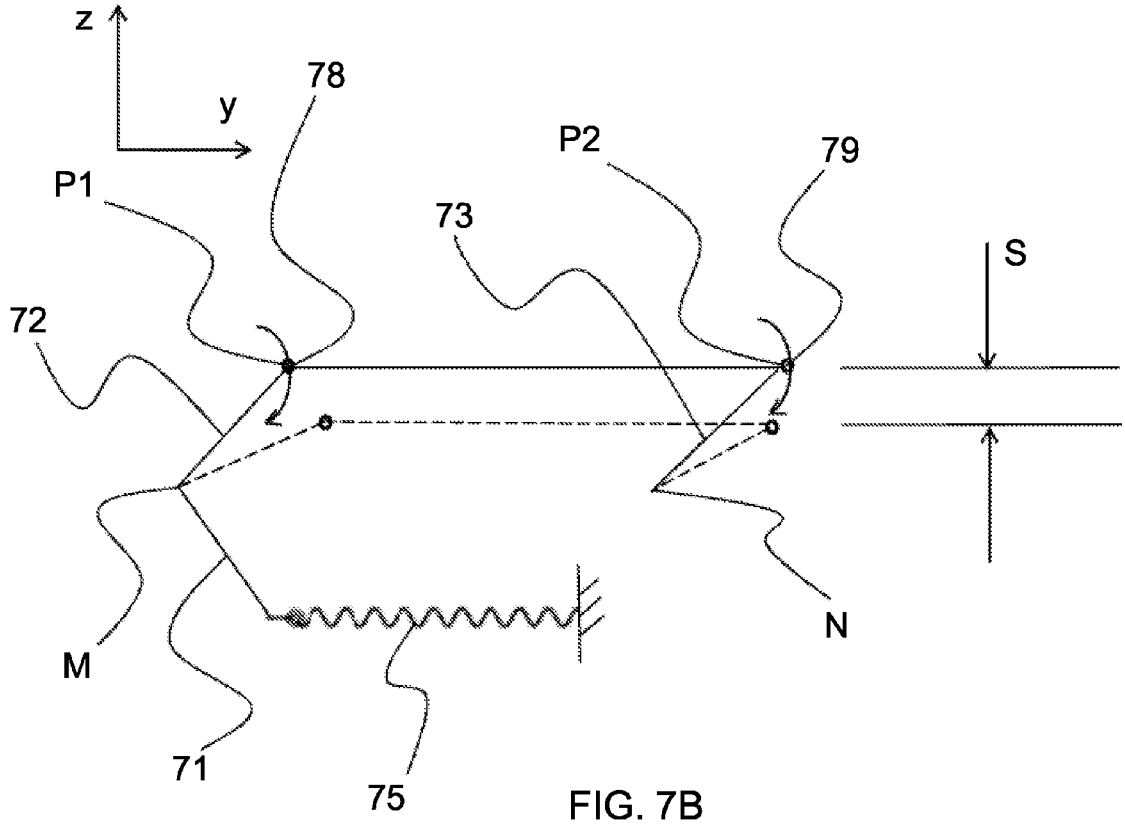
FIG. 7B is a diagrammatic representation of the 2-dimensional articulation of the floating media support cooperating with the printhead of one embodiment of the variable media feed system.
Figure 8:
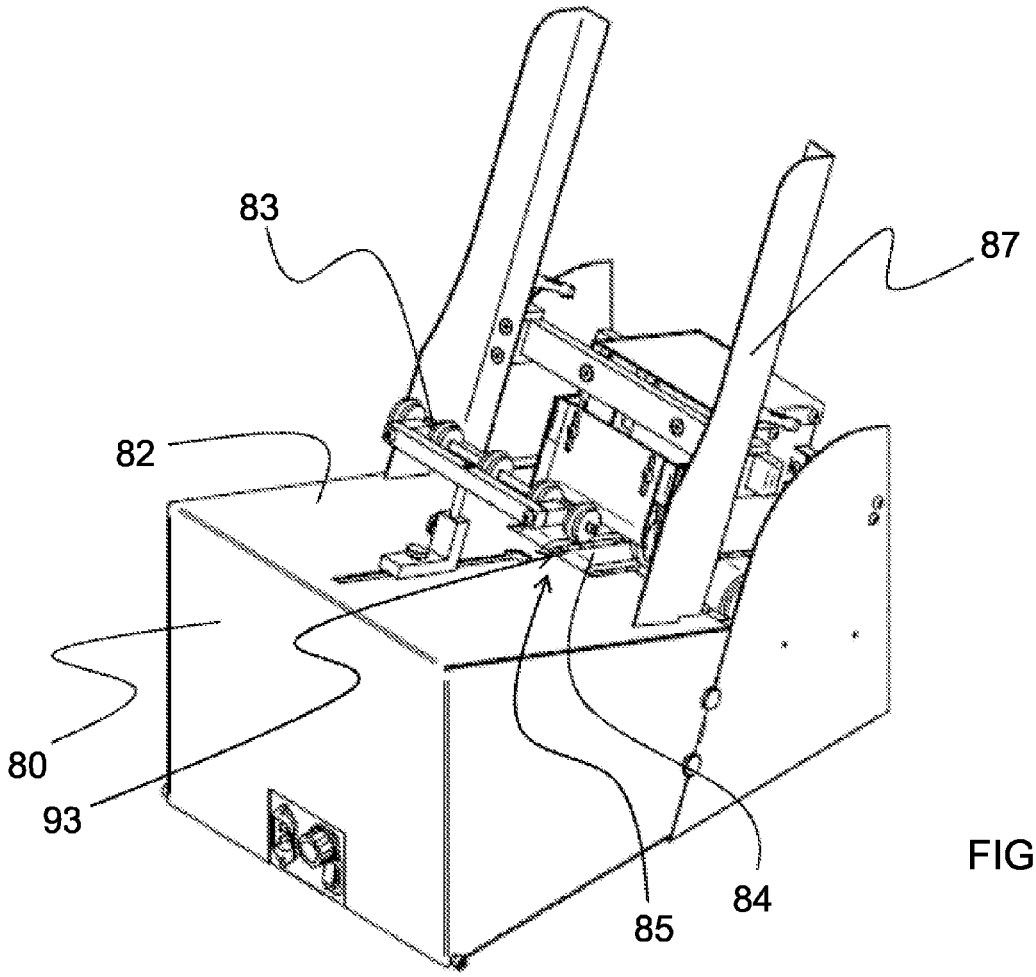
FIG. 8 is a perspective view of an embodiment of the present invention as a stand-alone media feeder for handling a batch of various thickness media.

Against this spring bias, the deck 20 can thus move both up and down, i.e. in a vertical z-direction component relative to the print head, and also have a horizontal vector component in the y-direction to accommodate differently sized media as seen in FIG. 7B. In this way if a thicker piece of media were to follow a thinner piece of media for example, as the thicker piece is drawn into the print zone 14 by the feed belt 70, the floating deck 20 is pushed vertically downwards to accommodate the media, i.e. the floating deck 20 flexes, about the axes p1, p2 against the spring bias of the front and rear support levers 71, 73 as they rotate about their own respective main axes M. Also, because of the rotational characteristics of the rotating lever arms 71, 73, the deck 20 also correspondingly moves slightly in the horizontal y-direction of travel of the incoming media to give with the incoming thicker media so that the transition of the deck 20 between thinner and thicker media is not so abrupt and does not only occur in the vertical z-direction.

With the front and rear support levers 71, 73 defining the same or similar radial distances R between M and p1, as well as N and p2, and being set in such a cantilevered arrangement and having a spring constant applied to the lever 71, when motivated, the deck platform 64 will float, i.e. move in the two dimensional y-z plane, in a parallel and substantially horizontal manner to accommodate different thicknesses of media and so provide consistent spacing along its length between the upper surface of the different size media with respect to the printhead 22.

The floating deck 20 may also have a micro-adjustment 17 as seen in FIGS. 1B-C which enables the floating deck 20 to be adjusted in at least the z-direction, and possibly the y-direction, relative to the printer head 22 so that the top surface of the floating deck 20 has an adjustable neutral position, i.e. where no media is applied to or on the deck 20, relative to the printhead 22. The micro-adjustment 17 is a manual mechanical or electro-mechanical mechanism, although it could be controlled via a data transmission and commands from a computer as well, which sets a desired position for the deck platform 64 by rotating or affecting the levers 71 and 73 in such a manner as to raise or lower the deck platform 64 to a neutral distance D (not shown) below the printhead 22. This micro-adjustment of the deck platform 64 can be accomplished by an operator prior to or even during the running of the apparatus so that a distance between the printhead 22 and the feed belt 70 running on the deck platform 64 can be optimized for the printing and feeding of a range of media thickness through the print zone 14. The micro-adjustment of the deck platform 64 is particularly helpful where a batch print run of media are all within a certain thickness and thus a more preferable neutral distance D can be set so that the entire range of media thickness in the batch pass through the print zone 14 at an appropriate speed and having the top surface of the media the desired distance S from the printhead 22. For example, if the distance D is too small, the friction and pressure between thicker media and the deflector plate 66 could slow the media down and disrupt the timing of the apparatus. If the distance D is too large then some thinner media may not be raised to the proper height to attain the distance S be printed effectively by the printerhead 22. The adjustment of the floating deck 20 in this manner is preferable to having to try and adjust the printhead 22 for individual media or even a batch since moving the printhead 22 introduces an entirely more difficult control dynamic to the apparatus.

The feed belt 70 extends around a set of print feed rollers 62 that are positioned on either side of the cantilevered deck platform 64. The print feed rollers 62 are rotated by a motor (not shown) within the base housing 16 and the feed belt 70 rolls along and around the deck platform 64 to draw the print media within the print zone 14. The backside of the media is defined as the site of the print media opposite the printhead 22 and the front side of print media is defined as the site adjacent to the printhead 22 which would receive any printing indicia. The backside is supported on the pulley belt 70 of the deck platform 64. As the print medium is drawn below the end of the deflector plate 66 and onto the feed belt 70, the rear support levers 71, 73 and ramp portions 72 are deflected dependent upon the thickness of the media presented. For thinner print media the springably biased nature of the ramp 72 and support levers 71, 73 are extended compressing the deck platform 64 towards the deflector plate 66. The hinge connections 71, 73 and rollers 78, 79 provide for the entire surface of the deck platform 64 to deflect evenly thereby maintaining alignment with the printhead 22. For thicker media introduced into the print zone 14, the support levers 71, 73 and front ramp 72 are folded pulling the entire surface of the deck platform 64 away from the deflector plate 66, while still maintaining alignment with the printhead 22. For any thickness of media the clearance distance between the media and printhead 22 remains essentially consistent with the thickness as defined by the media itself.

In this way, the floating deck 20 is allowed to move variably relative to the print zone surface 23 of the base housing 16 in order to accommodate different sized print media while the front side of the print media is maintained no matter what the thickness of the media against the deflector plate 66. The printhead 22 is maintained at a desired relative position to the deflector plate 66 so that as long as the front side of the print media slides along the pulley belt 70 the front surface of the media is always a safe distance from the printhead 22 no matter the thickness of each piece of print media fed into the print zone 14.

The media feed system described above may be used with any type of printing system as a standalone accessory to the printing system or as an integrated component of the printing system. In a standalone embodiment, shown in FIGS. 8-11, of the feeder system a feed system base 80 is provided having a media support surface 82 including an opening or openings through which a portion of the pulleys belts 84 of a first and second pulley belt set 85, 86 extend slightly above the plane define by the support surface 82. The support surface 82 may be angled downward in the direction the media is being fed, relative to ground or table surface supporting the apparatus and may have a media stand or fixture 83 to assist in aligning media along the support surface 82. The media stand 83 may be a simple support or may include motorized wheels or belts and pulleys to assist in feeding media to the feed zone. One or more stop walls 87 may also extend perpendicularly from the support surface 82 to guide media along the feed zone. The support surface 82 may also be flat or be provided with any such downward, or even upward angle depending on whatever follow-on media handling device the standalone system is intended to feed. This follow-on device could be for instance a printer, sorter, reader or other such similar apparatus.

Figure 9:
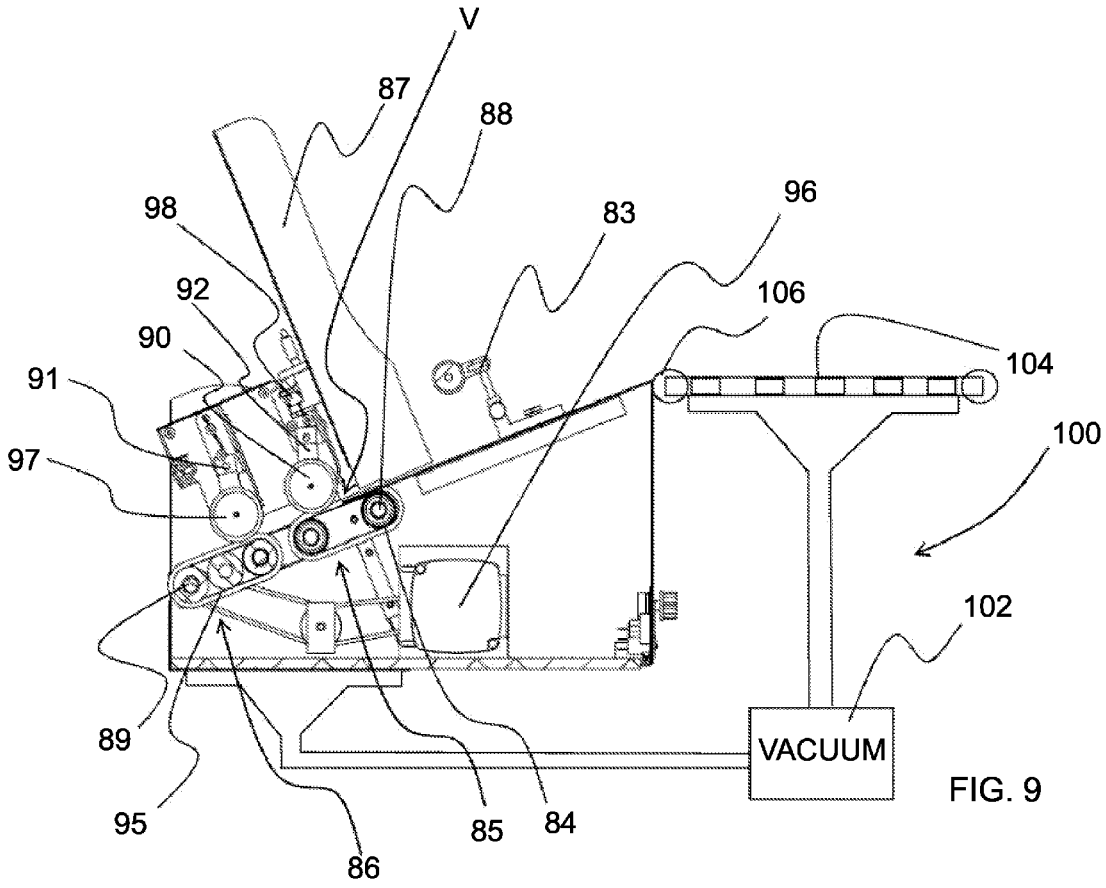
FIG. 9 is a cross-sectional view of an embodiment of the stand-alone media feeder for handling a batch of various thickness media.
Figure 10A:
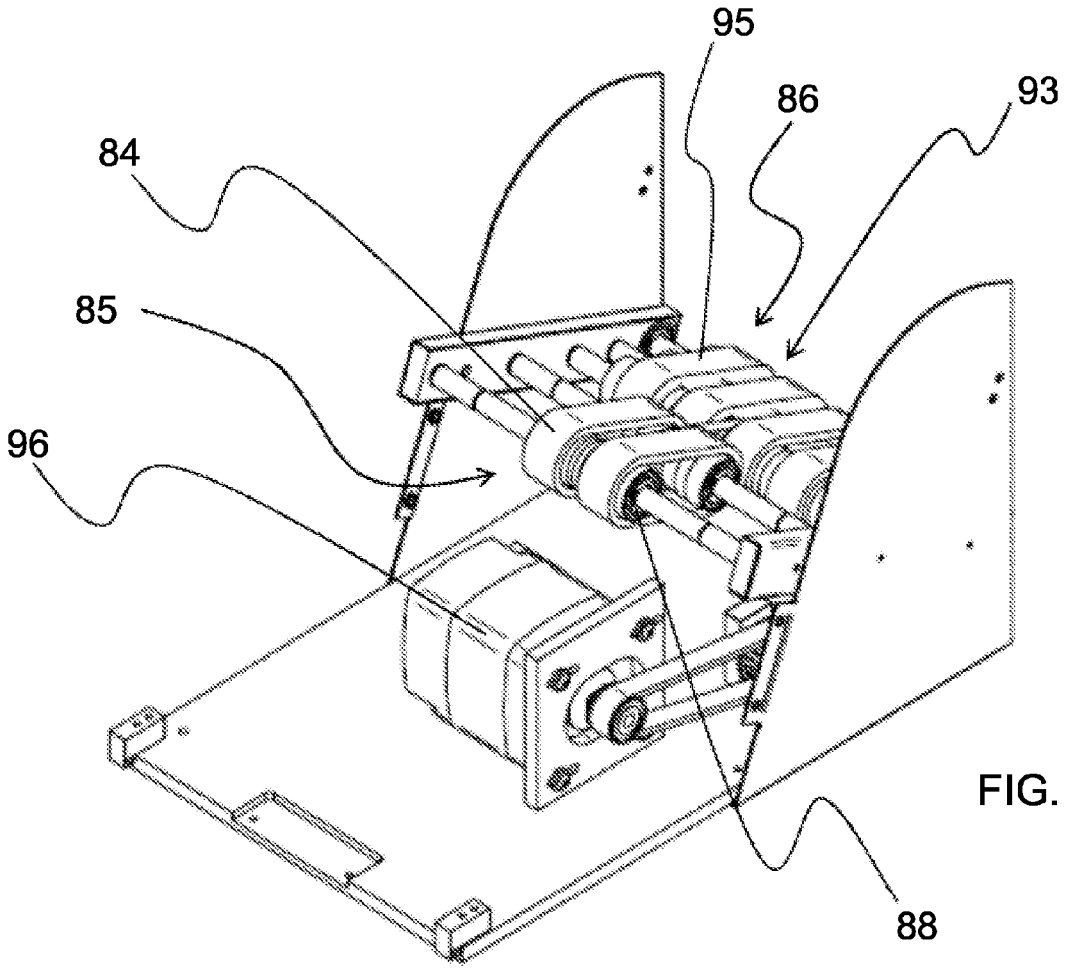
FIG. 10A is a perspective view of one embodiment of the assembled feed belts and rollers of the stand-alone media feeder for handling a batch of various thickness media.
Figure 10B:
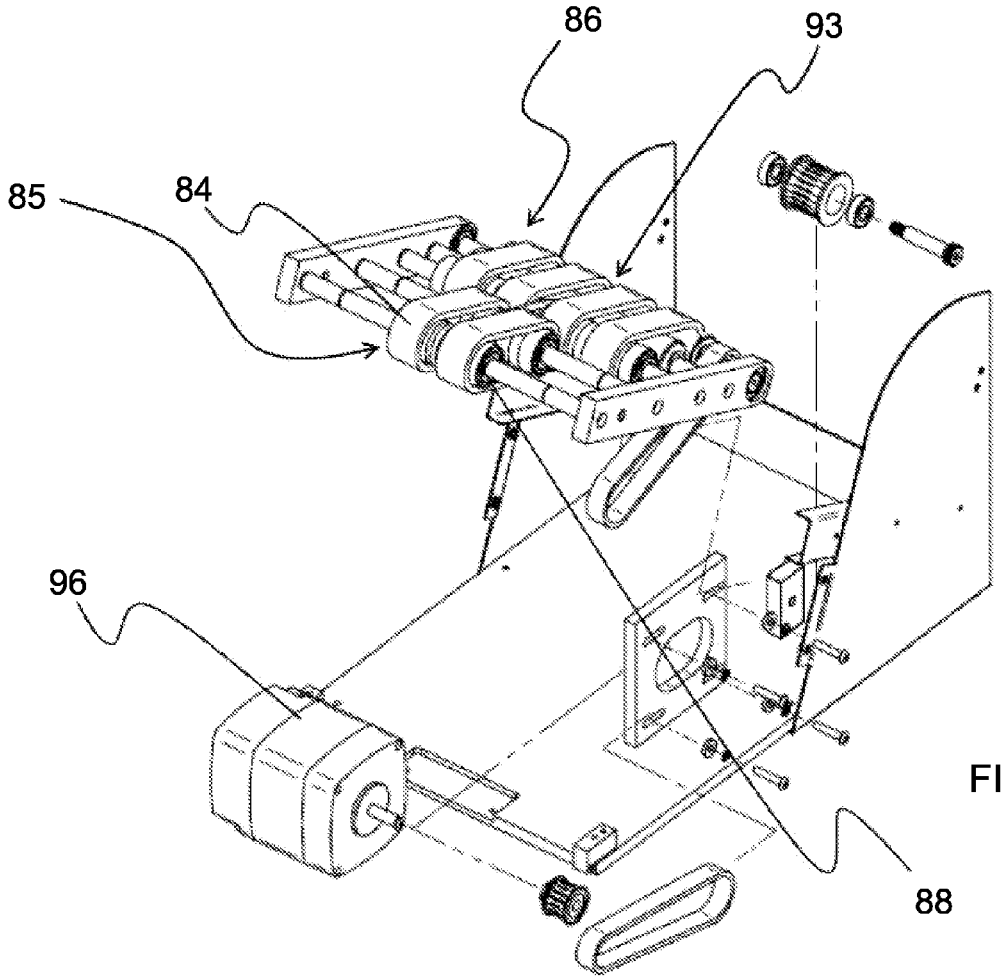
FIG. 10B is a perspective exploded view of one embodiment of the feed belts and rollers of the stand-alone media feeder for handling a batch of various thickness media; and Corresponding reference characters indicate corresponding parts throughout the several views. Even to the exemplification set out herein illustrate one preferred embodiment in the invention, in one form, and such exemplification is not to be construed as limiting the scope of the invention in any manner.

From a media introduction point the media is propelled through the feeder to a feeder end point where the media is introduced to the subsequent or follow-on media handling device the standalone system is intended to feed. Each pulley belt 84 of the first set 85 has a component which is rotating above the surface plane of the support surface 82 in such a manner so as to draw the media along a y-axis vector through the feeder. In this standalone embodiment the first set of pulley belts 85 have feed rollers 88 that are powered by a motor assembly 96 within the base 80, and the second set 86 have feed rollers 89 with belts 95 that may be driven by a separate motor or be connected to the feed rollers 88 by an appropriate gear or transmission member to rotate the second set of feed rollers 89 at the same or different speed from the first feed rollers 88 as shown in FIG. 9. One embodiment of the drive system for the pulley and belt sets 85, 86 is shown in FIGS. 10A and 10B.

Located above each of the adjacent pulley belt sets 85, 86 is a respective set of friction wheels 90, 97 which, in cooperation with the pulley belts, facilitate the singulation and transport of the media through the feeder. There are longitudinal spaces 93 between each pulley belt from the separation of the belts on the rollers 88, 89. Similar to the previous embodiment, the friction wheels 90 associated with the first set of pulley belts 84 are supported at the end of a respective support arm 92 which is supported on a pendulum shaft 91. The friction wheels 90 are free to rotate about their main axes relative to the support arm 92 and the support arm 92 is itself free to rotate in a springably biased manner controlled by spring 94 about the axis of the pendulum shaft 91. In their initial or neutral spring biased position the support arm 92 and the friction wheels 90 are maintained by their spring bias in a substantially vertical alignment substantially axially parallel with the z-axis. In this position, the pendulum shaft 91 and the support arm 92 maintain at least a portion of the outer circumference of the friction wheel 90 between the spaces or valleys 93 created between each belt 84.

Importantly, a portion of the circumference of the friction wheel 90 is positioned at or below the top surface of the pulley belt 84 exposed above the support surface 82. This is important because it helps maintain an upper and lower force on the media being transported as described above. These friction wheels 90 may freely rotate, or may be driven by a separate motor (not shown) to ensure that a desired amount of friction and pressure to supply a motive force on top of the media to pass the media through the feeder by the pulley belts 84 is applied. In some cases the friction wheels 90 may be driven in a reverse direction from the pulley belts 84 so that any media shingling, i.e. layered on top of a lower media being transferred along the support surface 82, is pushed back in the opposite direction and is not carried through the feeder along with the lower media.

The friction wheels 90 and the pulley belts 84 define a variable nip V as described above which includes at one extreme the overlap of the friction wheels 90 with the pulley belt 84 and increases within an allowable range with rotation of the support arm 92 so that there is a spacing between the outer circumferences of the pulley belts 84 and friction wheels 90 according to bias of the spring 94 and freedom of rotation of the arm 92 about the axis of the pendulum shaft 91. The variable nip size is important so that different thickness of media in the same batch can be sent through the feeder and the nip V can automatically adjust to accommodate the range of media thicknesses, even where every adjacent media piece is different thickness from the preceding and subsequent media piece in the same batch. This variability to accommodate different sized media occurs without a user's intervention or adjustment of the nip size during printing of the entire batch. In operation a thicker media may force the friction wheel 90 and the support arm 92 to rotate about the pendulum shaft 91 raising the friction wheel 90 up to accommodate the thicker media across the pulley belts surface 84. With a spring (not shown) biasing the support arm 92 and friction wheel 90 about the pendulum shaft 91, for instance with a coil spring and the inherent torsional increasing resistance, the pressure is accordingly increased by the friction wheel 90 on a top surface of the media as the nip V gets bigger. This increase in pressure assures that even as the nip V gets larger to accommodate thicker media, shingling is reduced or prevented as it becomes more difficult for media riding atop a lower most media on the support surface 82 to get through the nip V. Again, this feature of the present invention not only provides for variable thickness of media, but also helps prevent double feeding and improves singulation of the media through the feeder.

As shown in FIG. 9 the spring which biases the arm 92 in a substantially vertical position is a coil spring wrapped around the pendulum shaft 92 and having one end abutting a point on the arm and the opposing end of the spring abutting a cam located on a tension adjustment mechanism 98. The tension of the spring can be adjusted by the tension adjustment mechanism 98 to either increase or decrease the spring tension applied to the arm 92. A user can actuate a knob which rotates the cam to move the second end of the coil spring relative to the first end such that the coil spring is coiled more tightly about the pendulum shaft 91 to increase tension, or alternatively, rotating the knob and hence the cam in an opposite direction to relax the spring towards its neutral position to provide less tension on the support arm 91. This permits the user to adjust the spring tension on the arm 92 for purposes of controlling shingling and the pressure on the media as it passes through the nip V between the pulley belt 84 and friction wheel 90.

In other words, as stacked or shuffled pieces of media in a stacked batch are drawn into the feeder by the pulley belts 84 which propels the lowermost media forward the friction rollers 90 hold back the riding of vertically adjacent media atop the transported piece to prevent shingling despite the rotation of the support arm 92 to accommodate varying thicknesses of media. This is critical in that all the different thicknesses of media from a single loaded batch are drawn singly into the feeder and subsequently singly presented to the print head to receive the desired indicia. Each pendulum shaft 91 is attached along a support bracket and adjustment of the tensioning spring attached to the shaft 91 allows the friction wheel 90 to be adjusted to both apply sufficient pressure to the media surface and to rotate to allow media of different thickness to be drawn into the feeder. The pendulum shaft 91 and support arm deflect and rotate a greater amount for thicker media while still applying pressure.

The second pulley belt set 86 is similar in many regards to that described above with the exception that the belts 95 of the second set 86 may or may not run at higher speed than the first set 85. If set to run faster, similar to the first embodiment the second pulley belt set 86 may run in a range of about 1.5 to 3 times greater than the first pulley belt set 85. Located between each of the second set of adjacent pulley belts 95 is a second set of friction wheels 97 disposed in the spaces between each pulley belt 95. When set at a higher speed, the second pulley belt set 85 allows the lowermost piece of print media that has been drawn out of the stack by the first pulley belt 84 to accelerate and be propelled quickly through to the sensor 18 and print zone 14.

Similar to the first set of friction wheels 90, the second set of friction wheels 97 on cooperating with the second pulley set 86 may be rotatably supported on a support arm 92 and a pendulum shaft 91. This second set of friction wheels 97 and associated pendulum shaft 91 again facilitates the singulation as described above of the media by varying the nip space V and wheel pressure between the friction wheels 90, 97 and the pulley belts 84, 95 dependent upon the thickness of media passing through the nip V. The variable nip space between the friction wheels 90, 97 and the pulley belts 84, 95 is critical in ensuring that no matter what change in thickness of media is passed along the support surface 82 during the printing of a batch of different sized media the apparatus can accommodate the feeding and printing of such different thickness media without adjustment or interference from the operator.

In a further embodiment of the present invention shown in FIG. 9 a vacuum feeder system 100 may be provided as a standalone media feeder system or may be used in conjunction with the above described feeder systems. A vacuum pump and motor 102 are provided in communication with a vacuum loading surface 104 with rollers 106 and with an opening, or a plurality of openings formed in a respective media support surface 82 of a feeder system. For example, a vacuum 100, also understood as a lower pressure or suction force developed by the pump, may communicate with the openings or passages as described for example in the support surfaces 30, 82 in which the drive wheels 33 and nudger wheels 34 extend through the support surfaces 30, 82. The vacuum may also communicate with the openings or passages through which the pulley belt sets 37, 57 and 85, 86 extrude above the x-y plane defined by the support surfaces 30, 82 of the above two described embodiments. The vacuum 100 creates a downward suction force or pressure force through these openings which helps pull the media downwards against the support surfaces 30, 82 so that alignment and contact of the media is maintained with the support surfaces 30, 82 as the nudger wheels 33 and drive wheels 34 and respective pulley belts of the above described feeders draw the media through the feeder system.

The invention has been described in detail with particular reference to certain preferred embodiments thereof, but it will be understood that variations and modifications can be effected within the spirit and scope of the invention.

We claim:

1. A media feed apparatus for singulating stacked media, the apparatus comprising:

a load zone for receiving the stacked media that includes a plurality of individual media pieces;

a feed zone for singulating an individual media piece from the stacked media and moving the singulated media through the feed zone; and at least one nudger wheel located in the load zone for directly engaging a lowermost media deposited in the load zone;

wherein the nudger wheel defines a media-influencing transport vector as being non-parallel from a travel vector of the media along the feed apparatus;

wherein the media-influencing transport vector motivates an edge of the lowermost individual media piece against an alignment wall parallel with the travel vector of the media along the feed apparatus; and wherein the nudger wheel includes an offset portion extending radially beyond an outer circumference of the nudger wheel to motivate the stacked media in a substantially vertical direction at a desired frequency.

2. The media feed apparatus of claim 1, wherein the feed zone includes a first set of transport belts for transporting the media through the feed zone;

a second set of transport belts for receiving the transported media from the first set of rotating belts; and a first friction element rotatably suspended above the first set of transport belts defining a first singulating nip; and a second friction element rotatably suspended above the second set of transport belts, the second friction element defining a second singulating nip.

3. The media feed apparatus of claim 2, wherein at least the first friction element is spring biased and rotates between a first position and a second position.

4. The media feed apparatus of claim 2, wherein the second friction element is spring biased and rotates between a first position and a second position.

5. The media feed apparatus of claim 4 further comprising an adjustment mechanism for increasing the spring tension applied on the first friction element between the first and second positions.

6. The media feed apparatus of claim 5, wherein the second set of transport belts rotates faster than the first set of transport belts.

7. The media feed apparatus of claim 2, wherein the first friction element comprises a first end for contacting a top surface of the transported media and a second end connected to a pivot point.

8. The media feed apparatus of claim 7, wherein the first end of the first friction element comprises a rotational component that is rotatable about an axis spaced from the pivot point at the second end of the first friction element.

9. The media feed apparatus of claim 8, wherein the rotational component of the first friction element is positioned between adjacent transport belts of the first set of transport belts.

10. The media feed apparatus of claim 9, wherein in the first position of the first friction element an outer circumference of the rotational component is positioned below a plane defined by an upper surface of the transport belts and in the second position the outer circumference of the rotational component is positioned above the plane defined by the upper surface of the transport belts.

11. The media feed apparatus of claim 1 further comprising a processing zone, wherein the feed zone transports the individual media piece to the processing zone.

12. The media feed apparatus of claim 11, wherein the processing zone is a print zone.

13. The media feed apparatus of claim 11, wherein the processing zone is an image recording zone.

14. The media feed apparatus of claim 1 further comprising a processing zone having a media supporting deck which automatically adjusts a variable nip dependent upon a thickness of the transported media received from the feed zone, the media supporting deck including a friction wheel which contacts a pulley belt, the friction wheel being suspended on a spring-biased arm so as to force the friction wheel against the transported media on the pulley belt and to move upward to accommodate varying thicknesses of the transported media.

15. A print media feed system for media of variable thickness to feed a printer apparatus, the print media feed system comprising:

a load zone for loading printable media;

a plurality of nudger wheels supported on a shaft situated below the load zone;

a plurality of low speed transport belts situated in a feed zone having a plurality of rotatable friction elements pivotable about an axis positioned above the transport belts;

a plurality of high speed transport belts situated in the feed zone subsequent to the low speed transport belts also having a plurality of rotatable friction elements pivotable about an axis positioned above the high speed transport belts; and wherein the nudger wheels direct print media in a direction different from a media transport direction dictated by the high and low speed transport belts.

16. The print media feed system of claim 15, wherein the friction elements rotate about the axis between a first and a second position to define a variable nip to automatically accommodate print media of different thickness.

17. The print media feed system of claim 16 further comprising wherein the processing zone is a print zone having a media supporting deck moveably supported relative to the media feed system which automatically adjusts a printing nip dependent upon a thickness of the incoming media received from the feed zone of the printer apparatus.

* * * * *